US005107873A

United States Patent [19]

Clinger

[11] Patent Number: 5,107,873

[45] Date of Patent: Apr. 28, 1992

[54] CHAMBER CLEANING APPARATUS AND METHOD

[75] Inventor: David C. Clinger, Duncan, Okla.

[73] Assignee: Halliburton Company, Duncan, Okla.

[21] Appl. No.: 391,812

[22] Filed: Aug. 8, 1989

[51] Int. Cl.[5] ..... B08B 3/02

[52] U.S. Cl. ..... 134/56 R; 134/168 R; 134/181; 134/167 R; 239/DIG. 13

[58] Field of Search ..... 134/56 R, 172, 167 R, 134/181, 180, 168 R, 167 C; 74/30; 118/316, 317, 323; 239/DIG. 13

[56] References Cited

U.S. PATENT DOCUMENTS

| | | | |
|---|---|---|---|
| 471,931 | 3/1892 | Young, Jr. | 74/30 |
| 661,417 | 11/1900 | Mossman | 74/30 |
| 690,878 | 1/1902 | Roan | 15/104.1 R |
| 1,549,415 | 8/1925 | Hafer | 122/391 |
| 1,928,621 | 10/1933 | Frede et al. | 134/181 X |
| 3,225,777 | 12/1965 | Shelton et al. | 134/141 |
| 3,358,935 | 12/1967 | Andersen | 134/167 R |
| 3,817,262 | 6/1974 | Caradeur et al. | 134/172 X |
| 4,326,317 | 4/1982 | Smith et al. | 15/104.1 R |
| 4,603,661 | 8/1986 | Nelson et al. | 134/167 C X |
| 4,605,028 | 8/1986 | Passeman | 239/DIG. 13 |
| 4,646,768 | 3/1987 | Tanaka et al. | 134/167 R |
| 4,690,159 | 9/1987 | Vadakin et al. | 134/167 C |

*Primary Examiner*—Frankie L. Stinson

*Attorney, Agent, or Firm*—James R. Duzan; Lawrence R. Watson

[57] ABSTRACT

A chamber cleaning apparatus and method includes a conduit for conducting fluid into the chamber; a nozzle assembly, connected to the conduit, for creating one of an axial fluid spray to clean the interior surfaces of the first and second end walls of the chamber and a transverse fluid spray to clean the interior surfaces of the side walls of the chamber; a rotational drive assembly for rotating the nozzle means about a rotational axis generally parallel or coaxial with the longitudinal axis of the chamber; an axial drive assembly for moving the nozzle means a preselected distance toward or away from the first end wall of the chamber for each rotation of the nozzle assembly; a transverse drive assembly for moving the nozzle assembly a preselected transverse distance toward or away from the rotational axis for each rotation of the nozzle assembly. A swivel is provided having an outer sleeve body and an inner sleeve body with the inner sleeve body coaxially and rotatably positionable in the outer sleeve body. Two outer passageways extend through the outer sleeve body and two inner passageways extend through the inner sleeve body. Two circumferential channels are provided in the inside surface of the outer sleeve body. One outer passageway and one inner passageway is in continuous fluid communication with each circumferencial channel. A four-point beam support for supporting the cleaning apparatus is also provided.

37 Claims, 12 Drawing Sheets

CHAMBER CLEANING APPARATUS AND METHOD

BACKGROUND OF THE INVENTION

This invention relates generally to apparatus and methods for cleaning chambers and more particularly to apparatus and methods for cleaning slag and refractory material from the interior surfaces of a coal fed cyclone burner attached to a boiler.

Coal-fired boilers are commonly used by industry. For example, utility companies use coal-fired boilers to heat water for generating steam which drives electric generators. Pulverized coal is fed into one such boiler through a cyclone burner which receives the pulverized coal from a feeder apparatus connected to the inlet of the cyclone burner. Initial burning occurs inside the cyclone burner ("cyclone") with further burning occurring in the boiler.

Burning of the coal creates iron slag deposits (sometimes as much as two to three feet thick) on the interior walls of the cyclone. Although some amount of slag is known to assist the combustion, too much is detrimental. Therefore, the inside surfaces of the cyclone need to be cleaned periodically to reduce the deposits to the desired level or thickness. Also, refractory materials may be present on the inside surfaces of the boiler which need to be removed or cleaned from the inside surfaces to allow inspection and ultrasonic testing of the boiler tubes.

Past cleaning techniques have been labor intensive and even the semi-automated cyclone cleaning apparatus have required an operator to enter the cyclone and rearrange or replace high pressure fluid nozzles in order to clean the various inside surfaces of the cyclone. Such a semi-automated apparatus is described in U.S. Pat. No. 4,603,661, which is incorporated herein by reference thereto.

Therefore, there is a need for a chamber, cyclone, or boiler cleaning apparatus and method which can clean the cyclone more quickly, while reducing attendant operator time. There is also a need for a more precise technique of cleaning to ensure consistent cleaning jobs from one cyclone to the next regardless of the construction differences between the cyclones. It is also desirable to have an apparatus and method by which the cyclones can be cleaned more economically.

SUMMARY OF THE INVENTION

Accordingly, the cleaning apparatus and method of the present invention are used for cleaning a chamber, such as found in a cyclone burner or boiler, with a fluid from a fluid source. The cleaning apparatus includes conduit means, nozzle means, rotational drive means, axial drive means, and support means. The conduit means is used for conducting fluid from the fluid source into the chamber. The nozzle means is connected to the conduit means for creating a selectable one of an axial fluid spray to clean the interior surfaces of the first and second end walls of the chamber and a transverse fluid spray to clean the interior surfaces of the side walls of the chamber. The rotational drive means is used for rotating the nozzle means about a rotational axis generally parallel or coaxial with the longitudinal axis of the chamber. The axial drive means is used for moving the nozzle means toward and away from the first end wall. The axial drive means moves the nozzle means a preselected distance for each rotation of the nozzle means.

The support means is used for supporting the nozzle means and for allowing motion of the nozzle means. The cleaning apparatus may also include transverse drive means for moving the nozzle means transversely toward or away from the rotational axis. The transverse drive means moves the nozzle means a preselected distance for each rotation of the nozzle means.

The rotational drive means includes rotational enabling means, rotational preselecting means, rotational counting means, and rotational disabling means. The rotational enabling means is used for enabling the rotational drive means to rotate the nozzle means. The rotational preselecting means is used for preselecting the number of rotations of the nozzle means to be made after enablement of the rotational drive means. The rotational counting means is used for counting the number of rotations of the nozzle means. The rotational disabling means is used for disabling rotation of the nozzle means when the preselected number of rotations are completed.

The axial drive means includes axial enabling means, axial preselecting means, axial measuring means, and axial disabling means. The axial enabling means enables the axial drive means to move the nozzle means when the rotational disabling means disables rotation of the nozzle means. The axial preselecting means is used for preselecting the distance the nozzle means may be moved by the axial drive means after enablement of the axial drive means. The axial measuring means is used for measuring the distance the nozzle means is moved by the axial drive means. The axial disabling means is used for disabling movement of the nozzle means by the axial drive means when the nozzle means has been moved the preselected distance by the axial drive means.

The transverse drive means includes transverse enabling means, transverse preselecting means, transverse measuring means, and transverse disabling means. The transverse enabling means is used for enabling the transverse drive means to move the nozzle means when the rotational disabling means disables rotation of the nozzle means. The transverse preselecting means is used for preselecting the distance the nozzle means may be moved by the transverse drive means after enablement of the transverse drive means. The transverse measuring means is used for measuring the distance the nozzle means is moved by the transverse drive means. The transverse disabling means is used for disabling movement of the nozzle means by the transverse drive means when the nozzle means has been moved the preselected distance by the transverse drive means.

The cleaning apparatus and method also include switch means for preselecting one of the axial drive means and the transverse drive means to move the nozzle means when the rotational drive means is disabled.

The cleaning apparatus and method may also include a first swivel. The first swivel includes an outer sleeve body and an inner sleeve body which is generally coaxially and rotatably positionable in the outer sleeve body. The outer sleeve body includes an outside surface, an inside surface, and at least one outer passageway extending through the outer sleeve body from the outside surface to the inside surface. The outer passageway has a first end through the outside surface and a second end through the inside surface.

The inner sleeve body includes an outside surface, an inside surface, and at least one inner passageway extending through the inner sleeve body. The inner passageway has a first end fluidly communicable with the second end of the outside passageway and a second end.

The first swivel also includes circumferential channel means for placing the second end of the outer passageway in continuous fluid communication with the first end of the inner passageway. Preferably, the first swivel includes at least two outer passageways through the outer sleeve body, at least two inner passageways through the inner sleeve body, and at least two circumferential channel means. One outer passageway and one inner passageway is placed in continuous fluid communication with each circumferential channel means.

The cleaning apparatus includes an elongate hollow member having a first end connected to the inner sleeve body generally coaxially with the inner sleeve body and a second end connectable to the nozzle means. The rotational drive means rotates the conduit means about the rotational axis of the nozzle means. The conduit means passes generally concentrically through the inner sleeve body and elongate hollow member and is connected to the inner sleeve body of the first swivel so that the inner sleeve body and the elongate hollow member are rotated with the conduit means. The transverse drive means is located adjacent the nozzle means which is at the opposite end of the elongate hollow member from the rotational drive means. A signal conducting means is provided which includes a first segment fluid communicatingly connectable from the rotational drive means to the first end of the outer passageway of the outer sleeve body and a second segment. The second segment is fluid communicatingly connectable from the second end of the inner passageway of the inner sleeve body through the hollow elongate member to the transverse drive means so that the second segment rotates with the inner sleeve body.

The support means includes a beam which is positionable generally parallel or coaxially with the longitudinal axis of the chamber. The beam has a first end extending away from the chamber and a second end adjacent the inlet opening of the chamber. The present invention may also include a beam support for supporting the beam. The beam support is positionable in the inlet and includes vertical support means, first strut means, and second strut means. The vertical support means is used for extending generally linearly across the inlet to a first contact and a second contact with the inlet wall. The first strut means extends from the vertical support means to a third contact with the inlet wall. The third contact is located between the first and second contacts. The second strut means extends from the vertical support means to a fourth contact with the inlet wall. The fourth contact is located between the second and third contacts. Normally, the first, second, third, and fourth contacts are generally coplanar.

The method of the present invention includes: conducting fluid from the fluid source into the chamber; creating and selecting one of an axial fluid spray to clean the interior surfaces of the first and second end walls and a transverse fluid spray to clean the interior surfaces of the side walls; rotating the selected spray about a rotational axis generally parallel or coaxial with the longitudinal axis; and moving the spray axially toward or away from the first end wall a preselected distance for each rotation of the spray. The method also includes moving the spray transversely toward or away from the rotational axis a preselected distance for each rotation of the spray.

The method also includes preselecting the number of rotations of the spray to be made; counting the number of rotations of the spray; disabling rotation of the spray when the preselected number of rotations are completed; preselecting the axial distance the spray may be moved; enabling the spray to move axially when the rotational motion of the spray is disabled; measuring the axial distance the spray is moved; and disabling axial movement of the spray when the spray has been moved a preselected axial distance.

The method also includes preselecting the transverse distance the spray may be moved; enabling the spray to move transversely when the rotational motion of the spray is disabled; measuring the transverse distance the spray is moved; and disabling transverse movement of the spray when the spray has been moved the preselected transverse distance.

The method also includes preselecting whether the spray is enabled to be moved axially or transversely when rotational motion of the spray is disabled.

It is an advantage of the present invention to provide an automated cleaning apparatus and method for a chamber which reduces the time an operator must monitor operation of the apparatus.

It is an advantage of the present invention to provide a chamber cleaning apparatus and method which provides a precise technique of cleaning to ensure consistent cleaning jobs from one chamber to the next regardless of the construction differences between chambers.

It is an advantage of the present invention to provide a four point beam support which provides better resistance to torque and rotation and is easier to install than a three point support.

It is an advantage of the present invention to provide a swivel having a central cavity which is not used as a fluid path, rather the central cavity may be used to concentrically mount the swivel and passageways extending through the inner sleeve body of the swivel are used to conduct fluid through the swivel.

It is an advantage of the present invention to provide a swivel in which either the inner sleeve body or the outer sleeve body may remain stationary while the other is rotating.

It is an advantage of the present invention to provide a swivel which includes fluid paths which are not coaxial with the rotational axis of the swivel.

It is an advantage of the present invention to provide a nozzle assembly in which the direction of fluid spray can be changed by switching hose connections rather than physically rearranging the nozzles.

It is an advantage of the present invention to provide a nozzle assembly in which the direction of fluid spray can be changed by switching a hose between quick disconnect type connections thereby eliminating significant downtime previously required to change nozzle orientations.

It is an advantage of the present invention to provide a single nozzle assembly which contains nozzles to clean all the surfaces found in a typical cyclone chamber.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
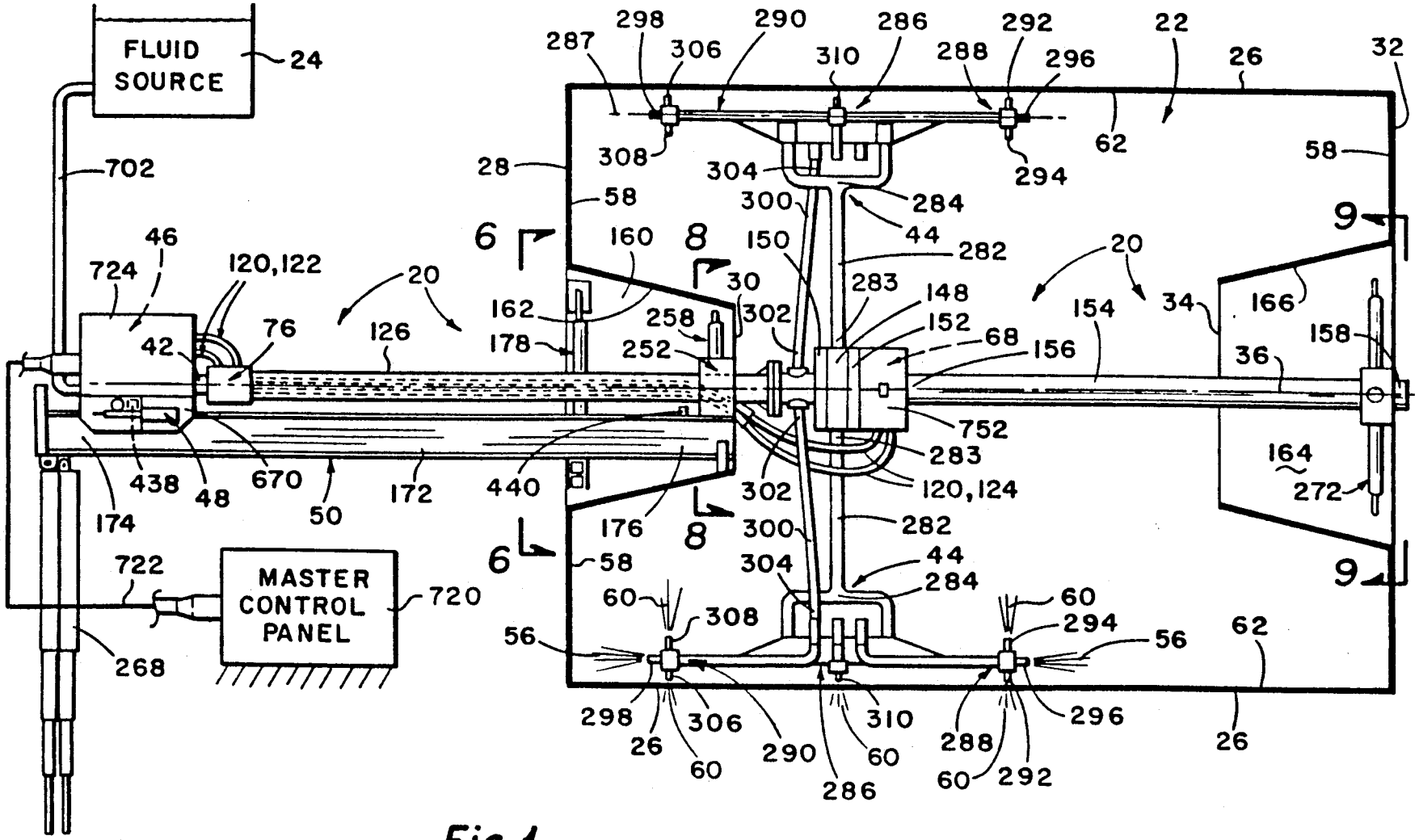
FIG. 1 is a schematic elevational view, partially in section, of an embodiment of the chamber cleaning apparatus of the present invention.

Before explaining the present invention in detail, it is to be understood that the invention is not limited to the details of construction and arrangement of parts illustrated in the accompanying drawings, since the invention is capable of other embodiments and of being practiced or carried out in various ways commensurate with the claims herein. Also, it is intended to be understood that the phraseology or terminology employed herein is for the purpose of description and not of limitation.

FIGS. 1-19 present embodiments of the chamber cleaning apparatus and method, generally designated 20, of the present invention. As exemplified in FIG. 1, the cleaning apparatus and method 20 is used for cleaning the chamber of a cyclone burner 22, although it is intended to be understood that the apparatus 20 may be used for cleaning virtually any type of chamber, also designated 22, conduit, pipe, or other enclosure.

Referring to the example of FIG. 1, the apparatus 20 cleans a chamber or cyclone burner 22 with a fluid from a fluid source 24, the preferred fluid being water. The chamber 22 includes a side wall 26, a first end wall 28 having an inlet opening 30, and a second end wall 32 having an outlet opening 34. The inlet and outlet openings 30, 34 generally define a longitudinal axis 36 extending through the interior of the chamber or cyclone burner 22.

Referring to the example of FIG. 1, the cleaning apparatus 20 may be described as being generally comprised of conduit means 42 for conducting fluid from the fluid source 24 into the chamber 22; nozzle means 44; rotational drive means 46; axial drive means 48; and support means 50. The nozzle means 44 is connectable to the conduit means 42 for creating a selectable one of an axial fluid spray 56 to clean the interior surfaces 58 of the first and second end walls 28, 32 and a transverse fluid spray 60 to clean the interior surfaces 62 of the side wall 26. The rotational drive means 46 rotates the nozzle means 44 about a rotational axis generally parallel or coaxial with the longitudinal axis 36. Preferably, the rotational axis is coaxial with the longitudinal axis 36 as illustrated in FIG. 1, and is therefore also designated 36. The axial drive means 48 moves the nozzle means 44 toward and away from the first end wall 28. The support means 50 supports the nozzle means 44 and allows motion of the nozzle means 44, i.e., the support means 50 allows the nozzle means 44 to rotate and move axially.

For purposes of defining the relationships between the components described herein, "axial" is defined as generally parallel to or coaxial with the longitudinal axis 36 of chamber 22. "Transverse" is defined as generally perpendicular to the longitudinal axis 36.

In the preferred embodiment, referring to the example of FIG. 1, the apparatus 20 includes transverse drive means, generally designated 68, for moving the nozzle means 44 transversely toward or away from the rotational axis 36. It is intended to be understood that the rotational axis and longitudinal axis 36 are coaxial in the preferred embodiment and as described herein, although they may be separate, preferably parallel, axes extending through the chamber or cyclone burner 22. The transverse drive means 68 and axial drive means 48 may be used with a cleaning apparatus independently of each other and independently of the other features of the present invention. Preferably, the transverse drive means 68 and axial drive means 48 are used in combination with one or more features of the present invention in order to enhance such features.

Figure 3:
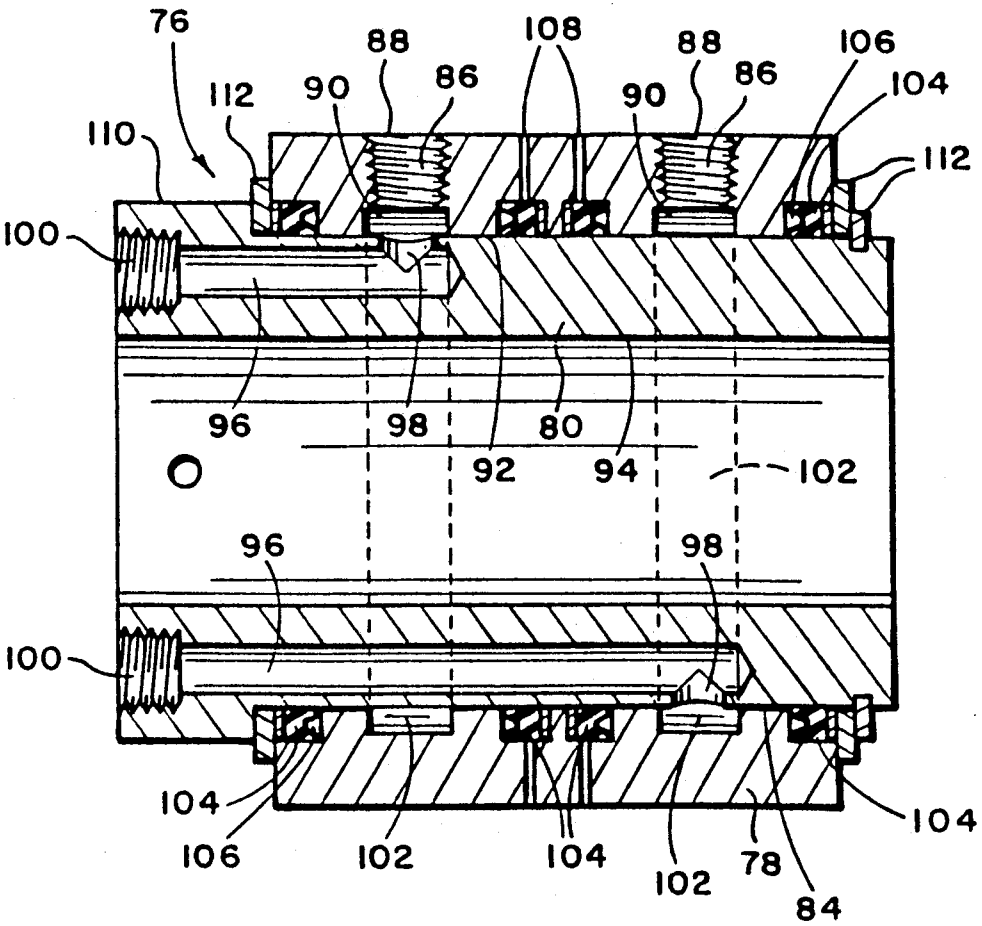
FIG. 3 is a sectional view taken along line 3—3 of FIG. 2.
Figure 2:
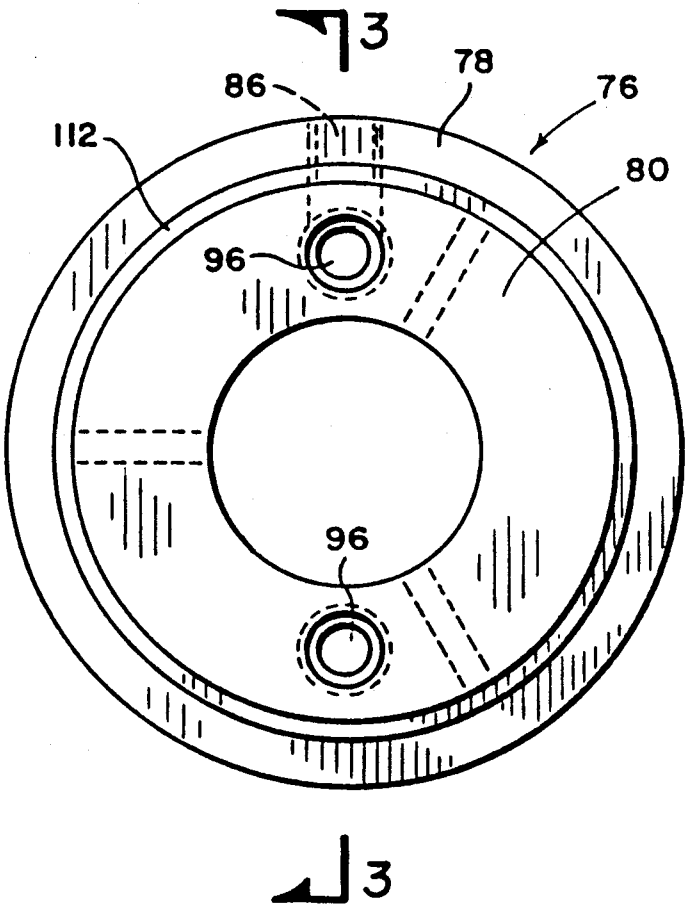
FIG. 2 is an end view of an embodiment of a swivel of the present invention.

Referring to the example embodiment of FIGS. 1, 2, and 3, the present invention also includes a first swivel 76. Referring now to FIGS. 2 and 3, the first swivel 76 may be generally described as comprising an outer sleeve body 78 and an inner sleeve body 80. The outer sleeve body includes an outside surface 82, an inside surface 84, and at least one outer passageway 86 extending through the outer sleeve body 78 from the outside surface 82 to the inside surface 84. The outer passageway 86 has a first end 88 extending through the outside surface 82 and a second end 90 extending through the inside surface 84. The inner sleeve body 80 is generally coaxially and rotatably positionable in the outer sleeve body 78, i.e., within the cavity of the outer sleeve body 78. The inner sleeve body 80 includes an outside surface 92, an inside surface 94, and at least one inner passageway 96 extending through the inner sleeve body 80. The inner passageway 96 has a first end 98 fluidly communicable with the second end 90 of the outer passageway 86 and the inner passageway 96 also has a second end 100. The inner passageway 96 may be used to conduct fluid allowing the cavity of the inner sleeve body 80 to be used to concentrically or coaxially mount the first swivel 76 on a tube, rod, pipe, or similar device.

The first swivel 76 also comprises circumferential channel means 102 for placing the second end 90 of the outer passageway 86 in continuous fluid communication with the first end 98 of the inner passageway 96. The circumferential channel means 102 may take any embodiment which will accomplish this function, e.g., a circumferential channel in the outside surface 92 of the inner sleeve body 80, a circumferential channel in the inside surface 84 of the outer sleeve body 78, or equivalent. In the preferred embodiment, referring to the example of FIG. 3, the circumferential channel means comprises a circumferential channel, also designated 102, in the inside surface 84 of the outer sleeve body 78. The circumferential channel 102 should be in continuous fluid communication with the second end 90 of the outer passageway 86 and the first end 98 of the inner passageway 96 throughout the rotation of the inner sleeve body 80 relative to the outer sleeve body 78. The circumferential channel means 102 provides a conduit which is continuously connected to both the outer passageway 86 and the inner passageway 96 thereby providing continuous fluid communication through the rotatable sleeve bodies 78, 80.

Referring to the example of FIG. 3, in the preferred embodiment, the first swivel 76 comprises at least two outer passageways 86 through the outer sleeve body 78, at least two inner passageways 96 through the inner sleeve body 80, and at least two circumferential channel means 102. One outer passageway 86 and one inner passageway 96 should be in continuous fluid communication with each circumferential channel means 102 thereby creating two paths of fluid communication through the sleeve bodies 78, 80 of the first swivel 76. Sealing means 104 are disposed between the inner sleeve body 80 and the outer sleeve body 78 in order to prevent fluid communication between the outer passageways 86, to prevent fluid communication between the inner passageways 96, and to prevent fluid communication from between the inner sleeve body 80 and the outer sleeve body 78 to the outside environment surrounding the first swivel 76. Preferably, the sealing means 104 are commercially available block vee seals which are compressed in circumferential seal channels 106 between the outer sleeve body 78 and the inner sleeve body 80. In the preferred embodiment, the circumferential seal channels 106 are formed in the outer sleeve body 78. Seal vents 108 are also provided to prevent malfunction due to air or fluid trapped behind the seals 104 and to aid in preventing fluid communication between outer passageways 86, between inner passageways 96, and between circumferential channel means 102.

Referring to the example of FIG. 3, in the preferred embodiment, the outer passageway 86 extends radially through the outer sleeve body 78; the first end 98 of the inner passageway 96 extends radially through the outside surface 92 of the inner sleeve body 80; and the second end 100 of the inner passageway 96 extends axially through the inner sleeve body 80. Also in the preferred embodiment, the inner sleeve body 80 has a protruding end 110 extending axially beyond the outer sleeve body 78 and the second end 100 of the inner passageway extends axially through the protruding end 110 of the inner sleeve body 80.

Retaining means 112 are provided for retaining the generally coaxial, rotatably positioning of the inner sleeve body 80 in the outer sleeve body 78. In the preferred embodiment, referring to the example of FIG. 3, the protruding end 110 of the inner sleeve body 80 is of larger outer diameter than the remainder of the inner sleeve body 80. The remainder of the inner sleeve body 80 is approximately the same outer diameter as the inside diameter of the outer sleeve body 78 thereby allowing the outer sleeve body 78 to concentrically and coaxially slide onto the inner sleeve body and to abut against the shoulder formed by the protruding end 110. The retaining means 112 preferably comprises a retaining ring and washers as are well known in the art. In the prototype first swivel 76, the retaining ring and washers also serve to retain the sealing means 104 which are located in the circumferential seal channels 106 at the axial extremities of the first swivel 76, e.g., the shoulder of protruding end 110 and a washer are used at one end of the outer sleeve body 78 and a retaining ring and washer are used at the other end of the outer sleeve body 78, as exemplified in FIG. 3.

In the prototype first swivel 76, the outer sleeve body 78 is made of aluminum bronze and the inner sleeve body 80 is made of 4140 high strength steel to provide natural lubricity and avoid the need for bearings.

The first swivel 76 may be used with rotating equipment independently of the other features of the present invention. Preferably, the first swivel 76 is used in combination with one or more features of the present invention in order to enhance such features.

In the preferred embodiment, the rotational drive means 46 provides a rotational signal indicating each rotation of the nozzle means 44 and the transverse drive means 68 responds to the rotational signal and moves the nozzle means 44 transversely toward or away from the rotational axis 36, as will be further discussed below. Referring to the example of FIG. 1, in the preferred embodiment, the cleaning apparatus 20 includes signal conducting means 120 connected between the rotational drive means 46 and the transverse drive means 68 for conducting the rotational signal from the rotational drive means 46 to the transverse drive means 68. Preferably, the signal conducting means 120 comprises a first segment 122 and a second segment 124. The first segment 122 is fluid communicatingly connectable from the rotational drive means 46 to the first end 88 of the outer passageway 86 of the outer sleeve body 78 (best seen in FIG. 3). The second segment 124 is fluid communicatingly connectable from the second end 100 of the inner passageway 96 of the inner sleeve body 80 to the transverse drive means 68. In the prototype cleaning apparatus 20 there are two signal conducting means 120, one signal conducting means 120 connected to each outer/inner passageway 86, 96 of the first swivel 76. Each signal conducting means 120 includes a first segment 122 and a second segment 124, as discussed above. The prototype signal conducting means 120 is made of hose or tubing suitable for conducting pneumatic signals.

Figure 4:
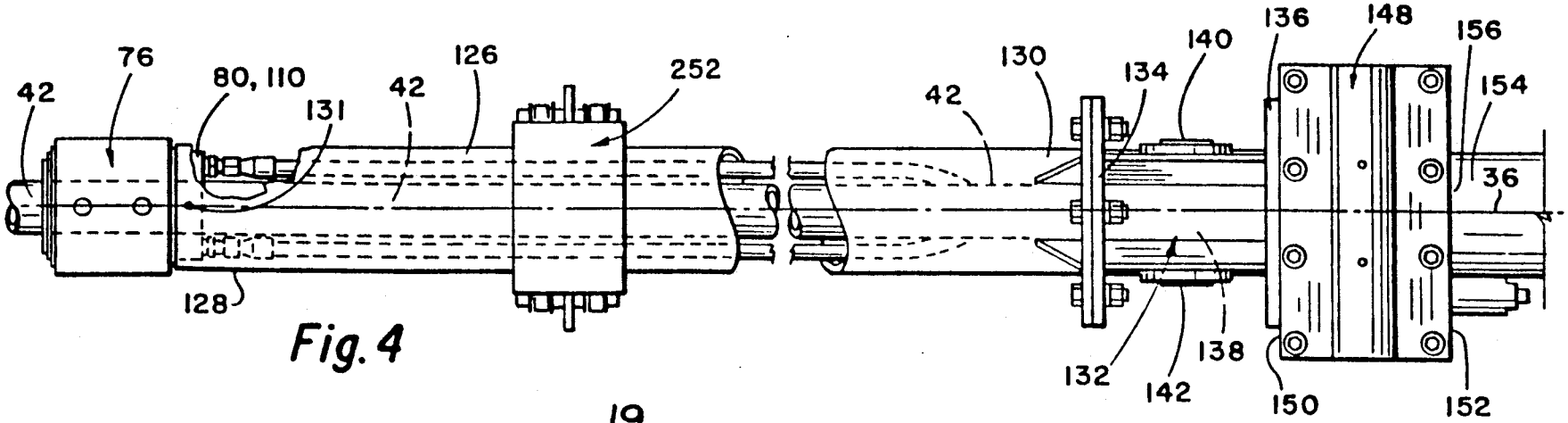
FIG. 4 is a plan view, partially cut away, of a partial assembly of rotating components of an embodiment of the present invention.

Referring to the example of FIG. 4, prototype elongate hollow member 126 has a first end 128 connectable to the inner sleeve body 80 generally coaxially with the inner sleeve body 80 and a second end 130 connectable to the nozzle means 44 (best seen in FIG. 1). Conduit means 42 passes generally concentrically through the inner sleeve body 80 and through the elongate hollow member 126 and is connected to the inner sleeve body 80 of the first swivel 76. As will be further explained below, the rotational drive means 46 rotates the conduit means 42 about the rotational axis 36 of the nozzle means 44 (which is normally the longitudinal axis of the conduit means 42). Since the conduit means 42 is connected to the inner sleeve body 80 and the elongate hollow member 126 is connected to the inner sleeve body 80, the inner sleeve body 80 and the elongate hollow member 126 are rotated with the conduit means 42 by the rotational drive means 46. Since the nozzle means 44 is connected to the second end 130 of the elongate hollow member 126, the nozzle means 44 is also rotated by the rotational drive means 46. In the prototype cleaning apparatus 20, the elongate hollow member 126 and conduit means 42 are commercially available pipe.

In the preferred embodiment, referring to the example of FIG. 4, the first end 128 of the elongate hollow member 126 fits over the protruding end 110 of the first swivel 76 and is fastened thereto with set screws 131 or equivalent fastening means. The first end 128 of the elongate hollow member 126 has an internal diameter which is slightly larger than the outside diameter of the protruding end 110 of the first swivel 76. The second end 130 of elongate hollow member 126 is connected to spacer 132. Spacer 132 has a first end 134 coaxially connectable to the second end 130 of elongate hollow member 126 and a second end 136 extending coaxially away from the second end 130 of the elongate hollow member 126. Spacer 132 is used to sealingly connect a fluid tee 138 to conduit means 42. The fluid tee 138 has an inlet (not illustrated) connected to the conduit means 42 and two outlets 140, 142 which may be fluid communicatingly connected to the nozzle means 44 as further discussed below. The fluid tee 138 is secured between the first and second ends 134, 136 of spacer 132 so that the inlet of the fluid tee 138 is fluid communicatingly connected to the conduit means 42 when the spacer 132 is connected to the elongate hollow member 130. In the prototype cleaning apparatus, the second end 130 of elongate hollow member 126 and the first end 134 of spacer 132 are flanged so that the spacer 132 and elongate hollow member 126 may be coaxially bolted together.

The second end 136 of spacer 132 is connected to indexing body 148. Indexing body 148 has a first side 150 connected to the second end 136 of spacer 132 and a second side 152 facing the opposite direction. Support member 154 has a first end 156 connected to the second side 152 of the indexing body and a second end 158 (best seen in FIG. 1) extending away from the indexing body 148 such that the support member 154 is generally coaxial with the elongate hollow member 126. In the prototype cleaning apparatus 20, the first and second sides 150, 152 of the indexing body 148 include bolt holes and the second end 136 of spacer 132 and the first end 156 of support member 154 are flanged so that they may be bolted to the indexing body 148. Normally, the transverse drive means 68 is located adjacent the nozzle means 44 to transversely extend and retract the nozzle means 44. In the preferred embodiment, as illustrated in FIG. 1, the transverse drive means 68 is connected to the second side 152 of the indexing body 148 adjacent the support member 154, as further discussed below. Normally, the second end 158 of the support member 154 extends through the outlet opening 34 of the chamber 22 coaxially with the longitudinal axis 36 of the chamber 22 when the cleaning apparatus 20 is installed in a chamber 22.

Referring to the example of FIG. 1, as previously mentioned, the cleaning apparatus 20 includes support means 50 for supporting the nozzle means 44 and for allowing motion of the nozzle means 44. Typically, the chamber or cyclone burner 22 has an inlet 160 having an inlet wall 162 surrounding the inlet opening 30. The inlet wall 162 extends generally axially from the first end wall 28 and is normally spaced from the side wall 26. In some types of cyclone burners 22, the inlet wall 162 extends axially away from cyclone burner 22 forming an antechamber (not illustrated) which is typically cylindrical in shape. Commonly, the inlet wall 162 extends into the cyclone burner 22 and often is frustoconically shaped as illustrated in FIG. 1. Typically, the cyclone burner 22 also has an outlet 164 having an outlet wall 166 surrounding the outlet opening 34 and extending generally axially from the second end wall 32. The outlet wall 164 is typically spaced from the side wall 26 and extends inwardly into the cyclone burner 22 from the second end wall 32 in a frustoconical shape, as also illustrated in FIG. 1.

In the preferred embodiment, referring to the example of FIG. 1, the support means 50 comprises a beam 172 which is positionable generally parallel or coaxially with the longitudinal axis 36 of the chamber 22. The beam 172 has a first end 174 extending away from the chamber 22 and a second end 176 adjacent the inlet opening 30. The support means 50 further comprises a beam support 178 positionable in the inlet 160. Referring to example FIG. 6, the beam support 178 comprises a vertical support means 180, first strut means 182, and second strut means 184. The vertical support means 180 is used for extending generally linearly across the inlet 160 to a first contact 186 and a second contact 188 with the inlet wall 162 and for elevating and supporting the beam 172 in its position generally parallel or coaxial with the longitudinal axis 36 of the chamber 22. The vertical support means 180 is typically positioned across the lower area of the chamber 22 and is positioned somewhat like a horizontal chord across the arc of the inlet wall 162.

The first strut means 182 is used for extending from the vertical support means 180 to a third contact 190 with the inlet wall 162 and for stabilizing the beam support 178. The third contact 190 is located between the first and second contacts 186, 188.

The second strut means 184 is used for extending from the vertical support means to a fourth contact 192 with the inlet wall 162 and for stabilizing the beam support 178. The fourth contact 192 is located between the second and third contacts 190, 192.

Figure 6:
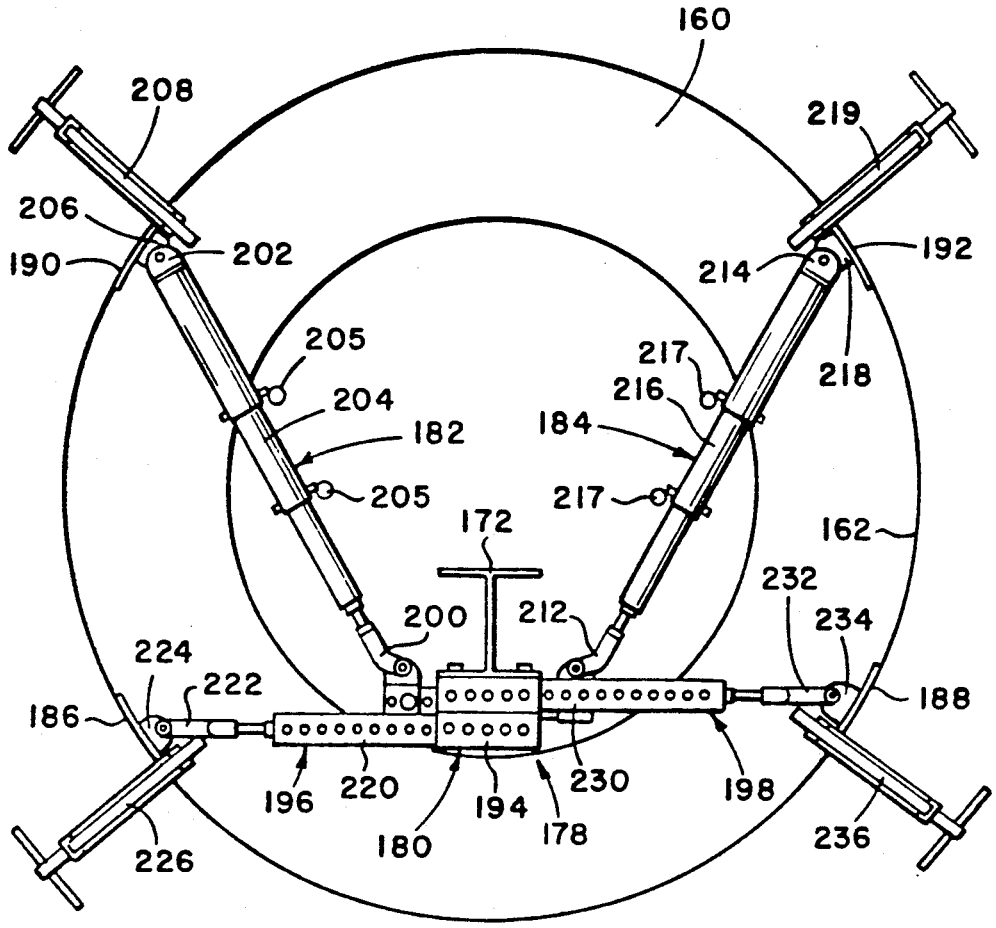
FIG. 6 is a view of an embodiment of the vertical support means of the present invention generally taken along line 6—6 of FIG. 1.
Figure 7:
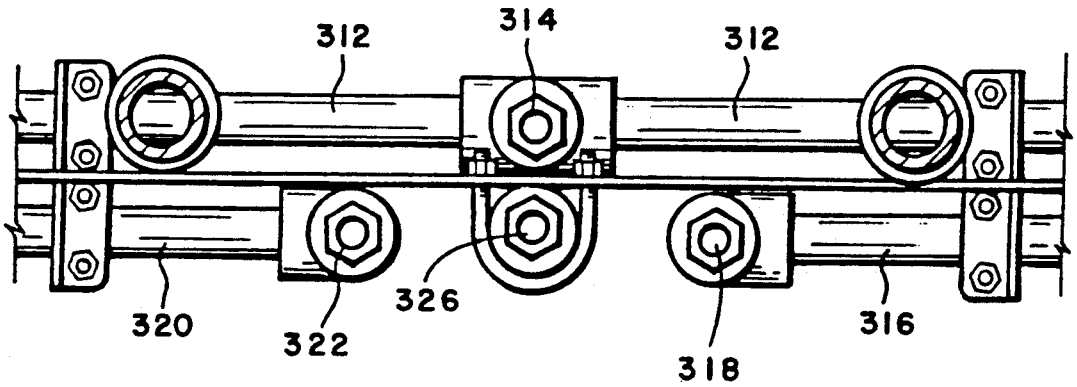
FIG. 7 is a view taken along line 7—7 of FIG. 10.

Referring to the example of FIG. 6, preferably the vertical support means 180 is positioned generally horizontally and transversely across the inlet 160 with the first strut means 182 extending generally upwardly from the vertical support means 180 to the third contact 190 and the second strut means 184 extending generally upwardly from the vertical support means 180 to the fourth contact 192.

In the preferred embodiment, referring to the example of FIG. 1, the first, second, third, and fourth contacts 186, 188, 190, and 192 are generally coplanar in order to maximize the structural strength and integrity of the beam support 178. In the preferred embodiment, referring to the example of FIG. 6, the third contact 190 is positioned about midway between the first contact and a line perpendicular to the generally linear extension of the vertical support means 180 at the center of the beam rest 194 and the fourth contact 192 is about midway between the second contact 188 and the line perpendicular to the vertical support means 180 at the center of the beam rest 194. In other words, the third contact 190 is positioned at a point approximately midway on the arc of the inlet wall 162 between the first contact 186 and the top of the inlet wall 162 and chamber 22 and the fourth contact 192 is similarly situated between the second contact 188 and the top of the inlet wall 162.

Referring to the example of FIG. 6, in the preferred embodiment, the vertical support means 180 comprises a beam rest 194 for supportingly contacting the beam 172; a first leg 196, extendably connected to the beam rest 194, for extending to the first contact 186; and a second leg 198, extendably connected to the beam rest 194, for extending to the second contact 188. Normally, the beam 172 will be approximately centered in the chamber 22 and the beam rest 194 should be approximately centered under the beam with portions of the beam rest extending beyond either side of the beam 172. The first strut means 182 is extendably connected to the beam rest 194 adjacent one side of the beam 172 and the second strut means 184 is extendably connected to the beam rest 194 adjacent the opposite side of the beam 172.

Referring to the example of FIG. 6, in the preferred embodiment, the first strut means 182 has a first end 200 pivotably connected to the beam rest 194 and a second end 202 which extends to the third contact 190 with the inlet wall 162. The first strut means 182 has a telescoping body 204 intermediate the first and second ends 200, 202 which allows the first strut means 182 to extend and retract from the third contact 190. Pins 205 or equivalent fasteners lock the sections of the telescoping body 204 at a selected length. At the second end 202 of the first strut means 182 is a pivotable foot 206 which will pivot into good contact with the inlet wall 162. The first end 200 is threadingly engaged with the telescoping body 204 to allow precise adjustment of the length of the first strut means 182. A C-clamp 208 may be used to clamp the pivotable foot 206 to the inlet wall 162 in order to ensure secure engagement between the first strut means 182 and the inlet wall 162.

Similarly to the first strut means 182, the second strut means 184 has a first end 212 pivotably connected to the beam rest 194 and a second end 214 which extends to the fourth contact 192 with the inlet wall 162. The second strut means 184 has a telescoping body 216 intermediate the first and second ends 212, 214 which allows the second strut means 184 to extend and retract from the fourth contact 192. Pins 217 or equivalent fasteners lock the sections of the telescoping body 216 at a selected length. At the second end 214 of the second strut means 184 is a pivotable foot 218 which will pivot into good contact with the inlet wall 162. The first end 212 is threadingly engaged with the telescoping body 216 to allow precise adjustment of the length of the second strut means 184. A C-clamp 219 may be used to clamp the pivotable foot 218 to the inlet wall 162 in order to ensure secure engagement between the second strut means 184 and the inlet wall 162.

The first leg 196 of the vertical support means 180 has a first end 220 telescopingly connected to the beam rest 194 and a second end 222 which extends to the first contact 186 with the inlet wall 162. The telescoping engagement of the first leg 196 with the beam rest 194 allows the first leg 196 to extend and retract from the beam rest 194 to the first contact 186. The first leg 196 and beam rest 194 are perforated so that the first leg 196 may be locked into an extended position with pins, bolts, or equivalent fasteners. At the second end 222 of the first leg 196 is a pivotable foot 224 which will pivot into good contact with the inlet wall 162. The second end 222 is threadingly engaged with the first leg 196 to allow precise adjustment of the length of the first leg 196. A C-clamp 226 may be used to clamp the pivotable foot 224 to the inlet wall 162 in order to ensure secure engagement between the first leg 196 and the inlet wall 162.

The second leg 198 of the vertical support means 180 has a first end 230 telescopingly connectable to the beam rest 194 and a second end 232 which extends to the second contact 188 with the inlet wall 162. The telescoping engagement of the second leg 198 with the beam rest 194 allows the second leg 198 to extend and retract from the beam rest 194 to second contact 188. Perforations are provided in the second leg 198 and beam rest 194 so that the second leg 198 may be locked into a selected length with pins, bolts, or equivalent fasteners. At the second end 232 of the second leg 198 is a pivotable foot 234 which will pivot into good contact with the inlet wall 162. The second end 232 is threadingly engaged with the second leg 198 to allow precise adjustment of the length of the second leg 198. A C-clamp 236 may be used to clamp the pivotable foot 234 to the inlet wall 162 in order to ensure secure engagement between the second leg 198 and the inlet wall 162.

Figure 8:
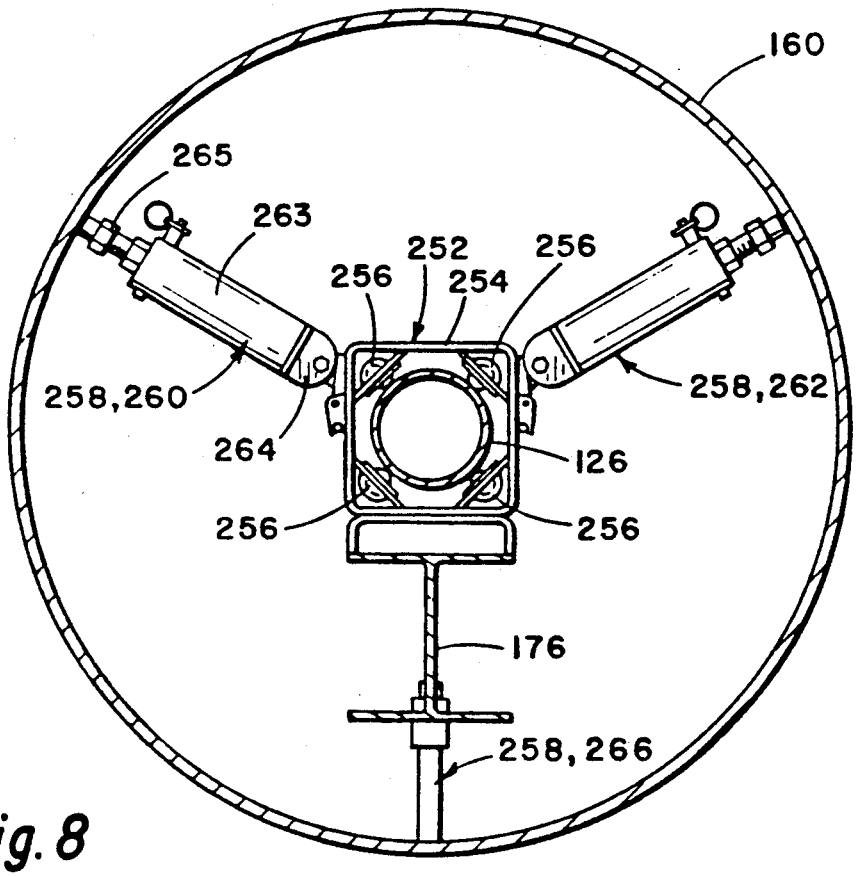
FIG. 8 is a view of an embodiment of the first support means of the present invention generally taken along line 8—8 of FIG. 1.
Figure 9:
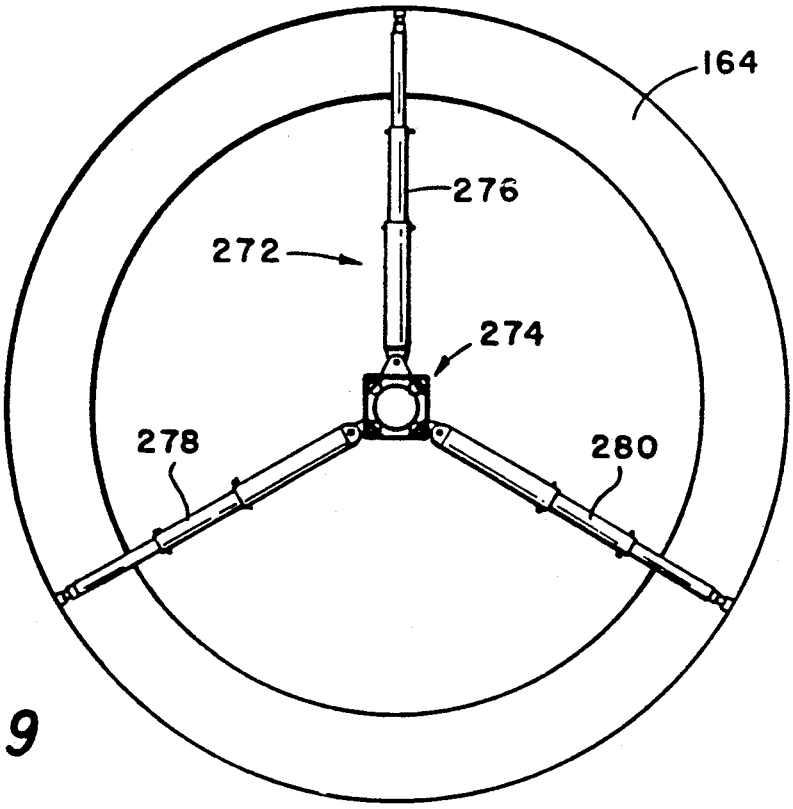
FIG. 9 is a view of an embodiment of the second support means of the present invention generally taken along line 9—9 of FIG. 1.

Referring to the example of FIGS. 1 and 8, in the preferred embodiment, the elongate hollow member 126 and conduit means 42 are rotatably mounted at the second end 176 of beam 172 with first bearing unit 252. First bearing unit 252 is securely fastened on the top side of the second end 176 of beam 172 and allows longitudinal or axial motion of the elongate hollow member 126 as well as rotation. The first bearing unit 252 includes a housing 254 which is generally rectangular in transverse cross-section. The housing supports four ball bearings 256, one ball bearing mounted in each inside corner of the housing 254. The elongate hollow member 126 extends through the first bearing unit 252 in contact with the four ball bearings 256 in order to allow rotational and axial motion of the elongate hollow member 126.

In the preferred embodiment, referring to the example of FIG. 8, the support means 50 also comprises a first support structure 258. In the preferred embodiment, the first support structure includes a first strut 260, a second strut 262, and a third strut 266. Preferably, the first and second struts 260, 262 are pivotably connected to the upper side of the housing 254 of the first bearing unit 252. The first and second struts 260, 262 are constructed similarly to the first and second strut means 182, 184 of the vertical support means 180 discussed above, e.g., each of the first and second strut 260, 262 includes a telescoping body 263, a first end 264 pivotably connected to housing 254 and a second end 265 which contacts the inlet wall 162. The second end 265 is threadingly engaged with the telescoping body 263 for precisely adjusting the length of the first and second struts 260, 262. The first support structure 258 also includes a third strut 266. Preferably, the third strut 266 is located at the second end 176 of beam 172 and is generally coplanar with the first and second struts 260, 262 when the struts 260, 262, 264 are in place and structurally supporting the beam 172. The third strut 266 is used to elevate the second end 176 of beam 172 in such a manner that the beam 172 is horizontal and generally parallel with the longitudinal axis 36 of chamber 22. Normally, the beam 172 should support the elongate hollow member 126 coaxially with the longitudinal axis 36 of chamber 22. The third strut 266 should be adjustable in length and may be a pedestal or similar spacer-type device. If the beam 172 must be elevated a great distance from the inlet wall 162, the third strut 266 may be constructed similarly to the first and second struts 260, 262. Normally, the first support structure 258 and first bearing unit 252 will be located at the second end 176 of beam 172 and the second end 176 of beam 172 will be located approximately at the end of the inlet 160 nearest to the interior of chamber 22, as best seen in FIG. 1.

In the preferred embodiment, referring to example FIG. 1, the support means 50 also includes a vertical standard 268 which is used to support the first end 174 of beam 172 when the first end 174 of beam 172 extends outside of the inlet 160 and chamber 22. The vertical standard 268 of the preferred embodiment is a tripod which is adjustable for accommodating different positions and elevations of the beam 172, as known to the art.

The inlet 160 may take various configurations and sizes. In some cases, the beam 172 may be substantially, if not entirely, located within the inlet 160. In such cases, the vertical standard 268 will not normally be needed and the beam 172 can be entirely supported by the vertical support means 180 and the first support structure 258. For example, in such an arrangement, the vertical support means 180 would be located at the externalmost end of the inlet 160 and the first support structure would be located at the innermost end of the inlet 160, as exemplified in FIG. 1. It is contemplated that the cleaning apparatus 20 will be used to clean chambers and cyclones 22 of many varying sizes, shapes, and configurations. For example, it is known that cyclone inlets 160 are made in cylindrical, as well as frustoconical, shapes and that the cyclone inlet 160 may extend axially outside of the chamber 22. The support means 50, vertical support means 180, and first support structure 258 should be selected and arranged to securely and stably support the beam 172 and cleaning apparatus 120 in the inlet 160.

As previously discussed, the preferred cleaning apparatus 20 includes support member 154, as exemplified in FIG. 1, support member 154 extends coaxially with the elongate hollow member 126 through the chamber or cyclone burner 22. In the preferred embodiment, referring to the example of FIGS. 1 and 9, the support means 50 includes a second support structure 272 which is mounted in the outlet 164 of chamber 22 and is used to hold the support member 154 and elongate hollow member 126 in a position generally parallel with the longitudinal axis of beam 172 and coaxial with the chamber axis 36. The second support structure 272 includes a second bearing unit 274 and first, second, and third struts 276, 278, 280. The second bearing unit 274 is of similar construction to the first bearing unit 252 and allows the support member 154 to rotate and move axially in chamber 22. The first, second, and third struts 276, 278, 280 are of similar structure as the first and second struts 260, 262 of the first support structure 258. Referring to the example of FIG. 9, preferably the first strut 276 extends vertically upwardly from the second bearing unit 274 and the second and third struts 278, 280 extend generally radially from the second bearing unit in such a manner that the first, second, and third struts 276, 278, 280 are about equally and coplanarly spaced around the second bearing unit 274.

Referring to the example of FIG. 1, in the preferred embodiment, the rotational drive means 46 rotates the conduit means 42 about the rotational axis 36 of the nozzle means 44 in order to rotate the nozzle means 44. In the preferred embodiment, the nozzle means 44 comprises a nozzle assembly, also designated 44. The nozzle assembly 44 comprises a transverse support arm 282 having a first end 283 connected to the conduit means 42 and a second end 284 extending transversely toward the side wall 26 of chamber 22; and a manifold assembly 286 connected to the second end 284 of transverse support arm 282. The prototype manifold assembly 286 has a longitudinal axis extending generally parallel to the longitudinal axis 36 of the chamber 22. The prototype manifold assembly 286 also has a first end 288 extending in one axial direction from the support arm 282 and a second end 290 extending in the other axial direction from the support arm 282.

In the preferred embodiment, referring to the example of FIG. 1, the nozzle assembly 44 also includes at least one nozzle 292, connected to the manifold assembly 286, for spraying fluid transversely away from the longitudinal axis 36 of the chamber 22; at least one nozzle 294, connected to the manifold assembly 286, for spraying fluid transversely toward the longitudinal axis 36 of the chamber 22; at least one nozzle 296, connected to the manifold assembly 286, for spraying fluid in one axial direction; at least one nozzle 298, connected to the manifold assembly 286, for spraying fluid in the other axial direction; and conducting means 300 for conducting fluid from the conduit means 42 to the manifold assembly 286. In the preferred embodiment, referring to the example of FIG. 1, the conducting means 300 is a high pressure certified hose, also designated 300, having a first end 302 connectable to the conduit means 42 and a second end 304 connectable to the manifold assembly 286.

More preferably, the nozzle assembly 44 comprises a first axial nozzle, also designated 296, connected to the first end 288 of the manifold assembly 286, for spraying fluid axially away from the first end 288 of the manifold assembly 286; a second axial nozzle, also designated 298, connected to the second end 290 of the manifold assembly 286 for spraying fluid axially away from the second end 290 of the manifold assembly 286; a first transverse nozzle, also designated 292, connected to the first end 288 of the manifold assembly 286 for spraying fluid transversely away from the longitudinal axis 36 of the chamber 22; a second transverse nozzle, also designated 294, connected to the first end 288 of the manifold assembly 286 for spraying fluid transversely toward the longitudinal axis 36 of the chamber 22; a third transverse nozzle 306, connected to the second end 290 of the manifold assembly 286 for spraying fluid transversely away from the longitudinal axis 36 of the chamber 22; a fourth transverse nozzle 308 connected to the second end 290 of the manifold assembly 286 for spraying fluid transversely toward the longitudinal axis 36 of the chamber 22; and a fifth transverse nozzle 310 connected to the manifold assembly 286 approximately midway between the first and second ends 288, 290 for spraying fluid transversely away from the longitudinal axis 36 of the chamber 22.

Figure 10:
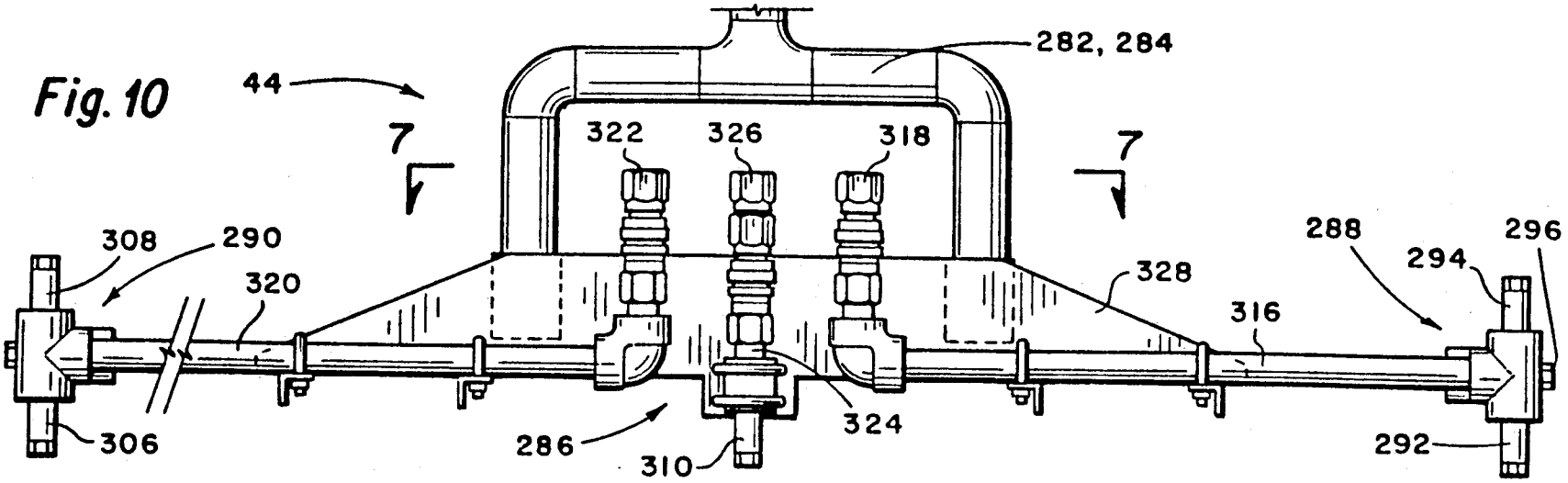
FIG. 10 is a plan view of an embodiment of a nozzle assembly of the present invention.
Figure 11:
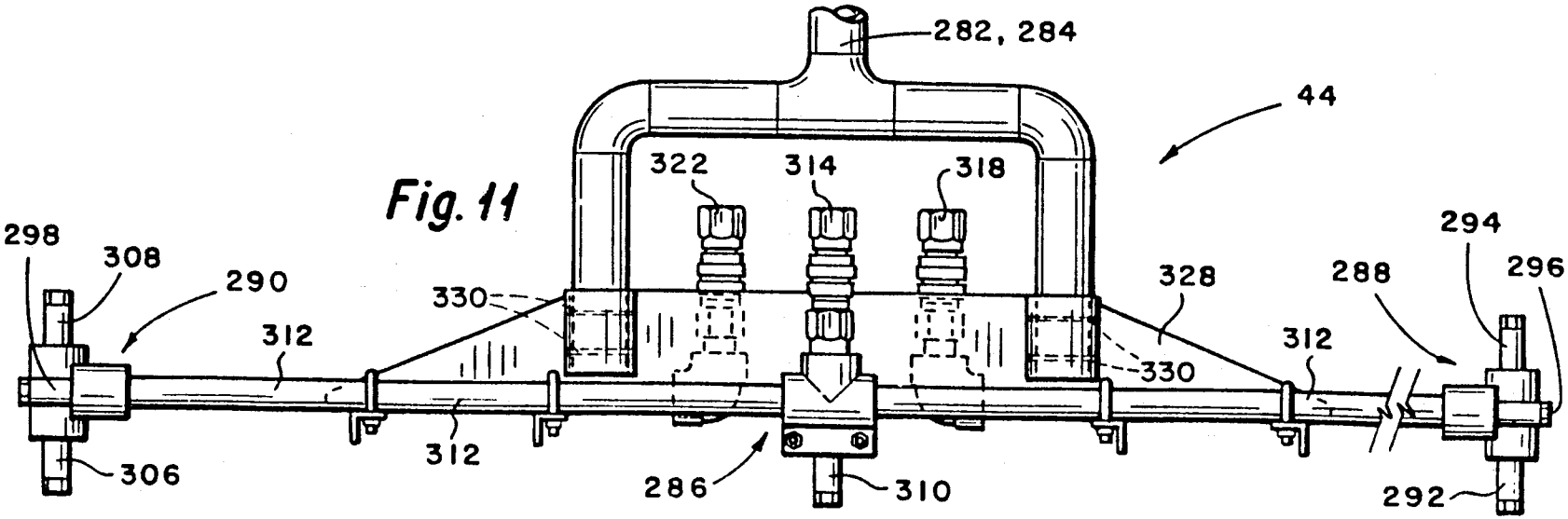
FIG. 11 is a bottom view of FIG. 10.

Referring to the example of FIGS. 10 and 11, in the preferred embodiment, the manifold assembly 286 includes a first manifold 312 connected to the first and second axial nozzles 296, 298 for conducting fluid to the first and second axial nozzles 296, 298. The first manifold 312 has an inlet connection 314. The manifold assembly 286 also includes a second manifold 316 connected to the first and second transverse nozzles 292, 294 for conducting fluid to the first and second transverse nozzles 292, 294. The second manifold 316 has an inlet connection 318. The manifold assembly 286 also includes a third manifold 320 connected to the third and fourth transverse nozzles 306, 308 for conducting fluid to the third and fourth transverse nozzles 306, 308. The third manifold 320 has an inlet connection 322. The manifold assembly 286 also includes a fourth manifold 324 connected to the fifth transverse nozzle 310 for conducting fluid to the fifth transverse nozzle 310. The fourth manifold has an inlet connection 326.

In the preferred embodiment, the inlet connections 314, 318, 322, 326 and the second end 304 of the conducting means 300 are provided with quick connect-type fittings, such as the Model No. 10-705 coupling manufactured by CEJN Products, Inc., so that an operator can quickly change the conducting means 300 from one manifold 312, 316, 320, 324 to another.

Figure 5:
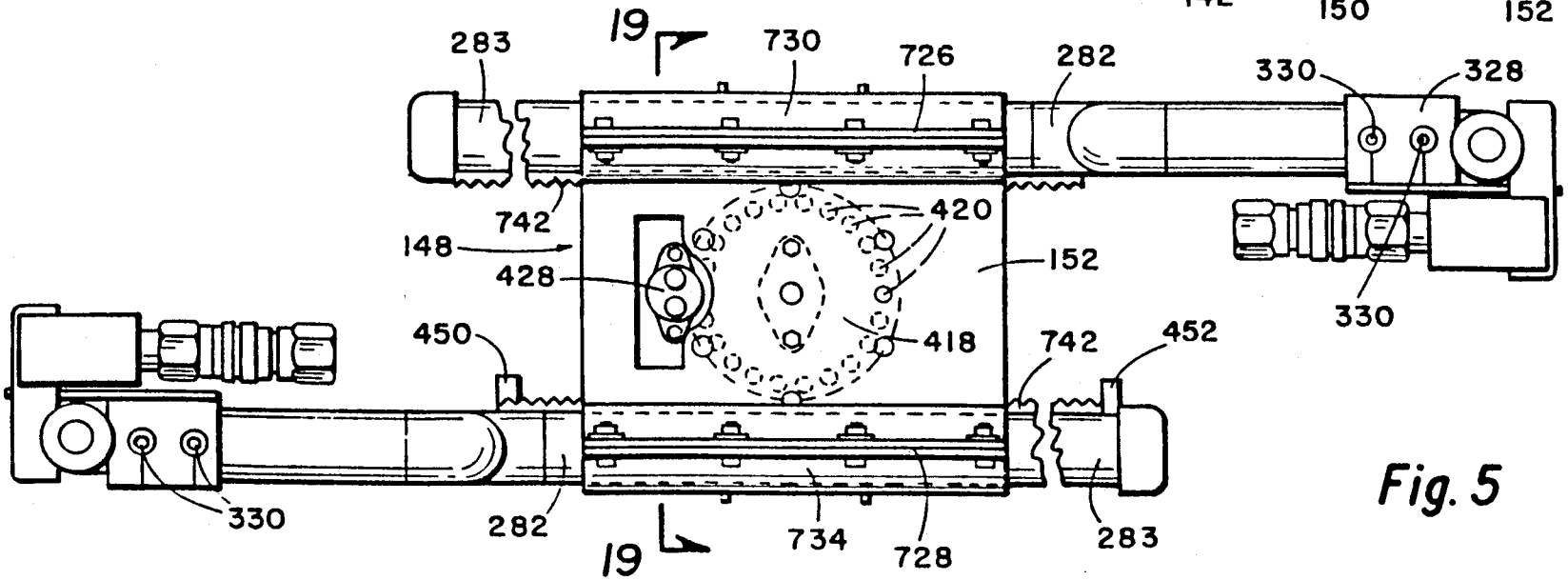
FIG. 5 is a view of an embodiment of the indexing body and nozzle assemblies of the present invention.

Also in the preferred embodiment, referring to the example of FIGS. 5, 10, and 11, the first, second, third, and fourth manifolds 312, 316, 320, 324 and the nozzles 292, 294, 296, 298, 306, 308, 310, are mounted on support plate 328. The support plate 328 is fastened to the second end 284 of the transverse support arm 282 with quick release pins 330 so that the manifolds 312, 316, 320, 324 and nozzles 292, 294, 296, 298, 306, 308, 310 can be quickly removed and installed.

As previously mentioned, in the preferred embodiment, the rotational drive means 46 rotates the conduit means 42 which rotates the inner sleeve body 80 of first swivel 76 which is connected to the elongate hollow member 126. The second end 130 of the elongate hollow member is connected to spacer 132 and spacer 132 is connected to indexing body 148. In the preferred embodiment, the first end 283 of the nozzle support arm 282 is connected to the indexing body 148, as further discussed below, and the rotational drive means rotates the conduit means 42 which rotates the indexing body 148 to rotate the support arms 282 and nozzle means or nozzle assembly 44.

Referring to the example of FIG. 1, in the preferred embodiment, there are two nozzle assemblies 44. Each nozzle assembly 44 has a transverse support arm 282 extending in opposite transverse directions from the conduit means 42 and from the indexing body 148. The arrangement of manifolds 312, 316, 320, 324 and nozzles 292, 294, 296, 298, 306, 308, 310 on the two nozzle assemblies 44 are identical.

As previously discussed, spacer 132 houses fluid tee 138 having a first outlet 140 and a second outlet 142. In the preferred embodiment, referring to example FIG. 1, two conducting means 300 are provided. The first end 302 of one of the conducting means 300 is connectable to the first outlet 140 of fluid tee 138 and the first end 302 of the other conducting means 300 is connectable to the second outlet 142 of fluid tee 138. In the prototype apparatus 20, the first ends 302 of the conducting means 300 threadingly engage the fluid tee outlets 140, 142. As previously discussed, the second end 304 of the conducting means 300 is used to connect the conducting means 300 to the inlet connections 314, 318, 322, 326 of the nozzle assemblies 44.

As previously discussed, the rotational drive means 46 rotates the nozzle means 44 about a rotational axis 36 generally parallel or coaxial with the longitudinal axis 36 of the chamber 22. In the preferred embodiment, the axial drive means 48 moves the nozzle means 44 a preselected distance for each rotation of the nozzle means 44. Also, in the preferred embodiment, the transverse drive means 68 moves the nozzle means 44 a preselected distance for each rotation of the nozzle means 44. The rotational drive means 46 may be used with either of the axial drive means 48 and transverse drive means 68 individually, and may be used with the axial drive means 48 and transverse drive means 68 in combination. Preferably, the rotational drive means 46, axial drive means 48, and transverse drive means 68 are used in combination, as further discussed below.

Figure 12A:
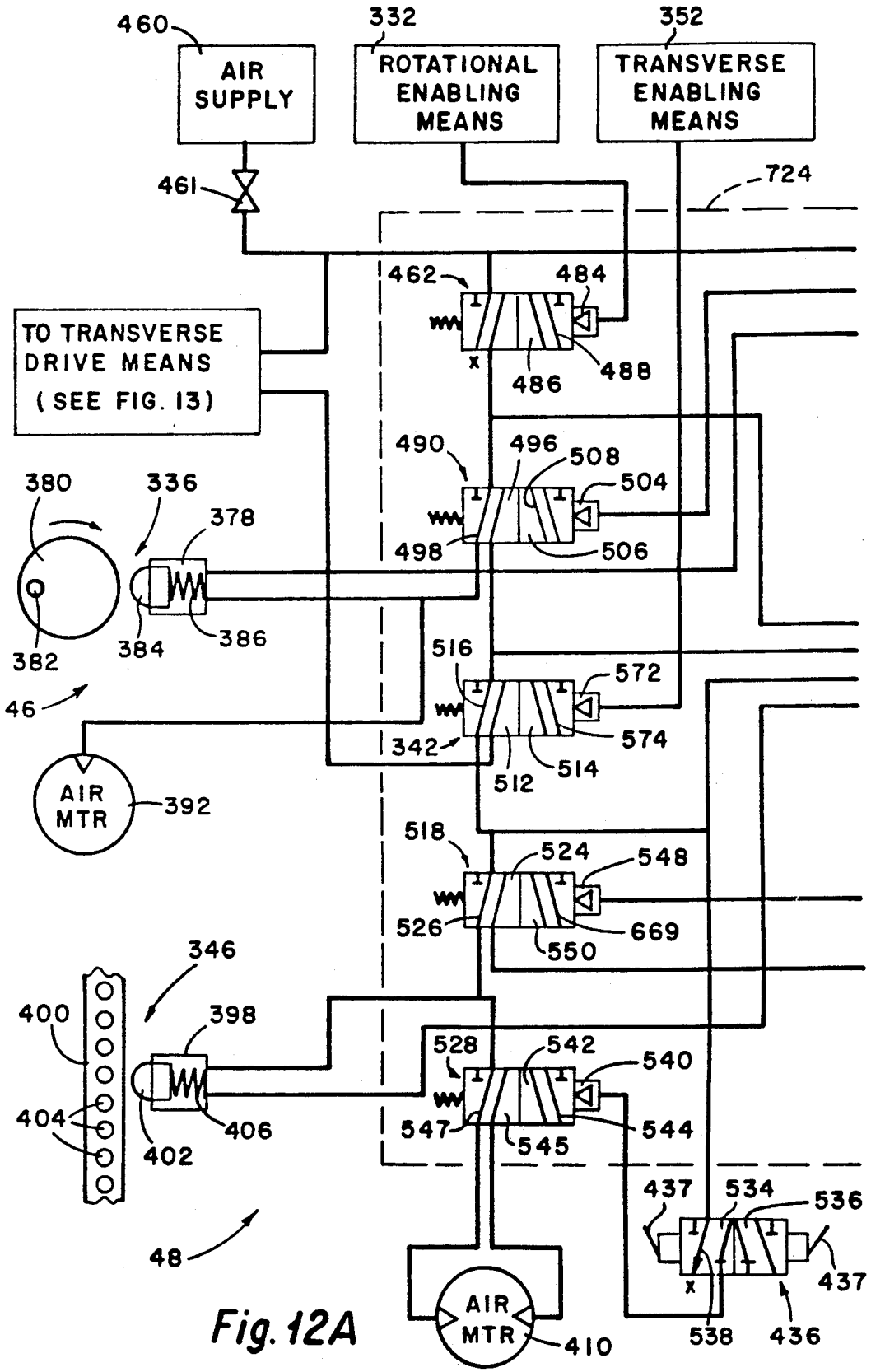
FIGS. 12A and 12B are, respectively, the left and right portions of a circuit diagram of an embodiment of the rotational drive means and axial drive means of the present invention.
Figure 12B:
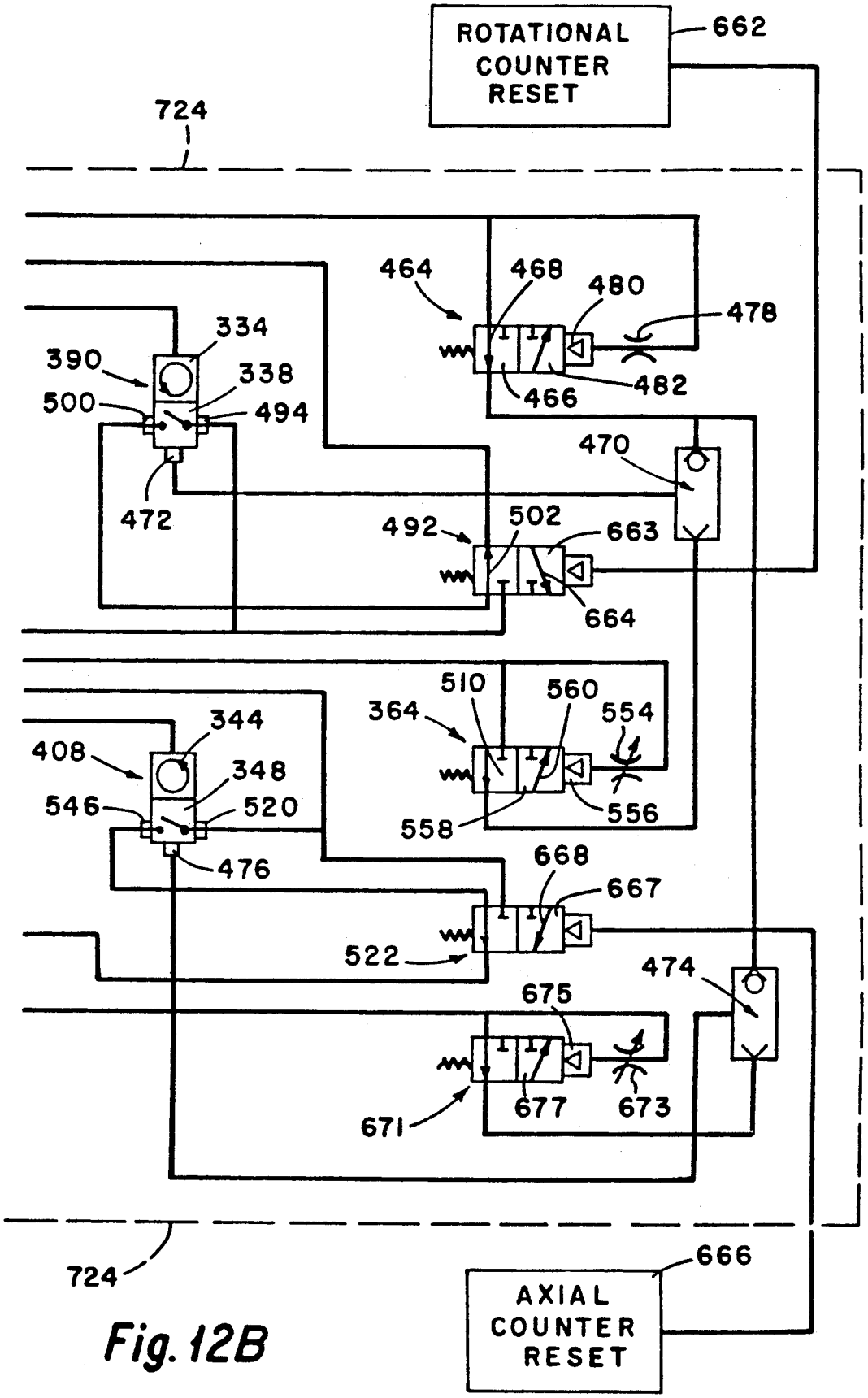

Referring to the example of FIG. 12, in the preferred embodiment, the rotational drive means 46 comprises rotational enabling means 332, rotational preselecting means 334, rotational counting means 336, and rotational disabling means 338. The rotational enabling means 332 is used for enabling the rotational drive means 46 to rotate the nozzle means 44. The rotational preselecting means 334 is used for preselecting the number of rotations of the nozzle means 44 to be made after enablement of the rotational drive means 46. The rotational counting means 336 is used for counting the number of rotations of the nozzle means 44. The rotational disabling means 338 is used for disabling rotation of the nozzle means 44 when the preselected number of rotations are completed.

Referring to the example of FIG. 12, in the preferred embodiment, the axial drive means 48 comprises axial enabling means 342, axial preselecting means 344, axial measuring means 346, and axial disabling means 348. The axial enabling means 342 is used for enabling the axial drive means 48 to move the nozzle means 44 when the rotational disabling means 332 disables rotation of the nozzle means 44. The axial preselecting means 344 is used for preselecting the distance the nozzle means 44 may be moved by the axial drive means 48 after enablement of the axial drive means 48. The axial measuring means 346 is used for measuring the distance the nozzle means 44 is moved by the axial drive means 48. The axial disabling means 348 is used for disabling movement of the nozzle means 44 by the axial drive means 48 when the nozzle means 44 has been moved the preselected distance by the axial drive means 48.

Figure 13:
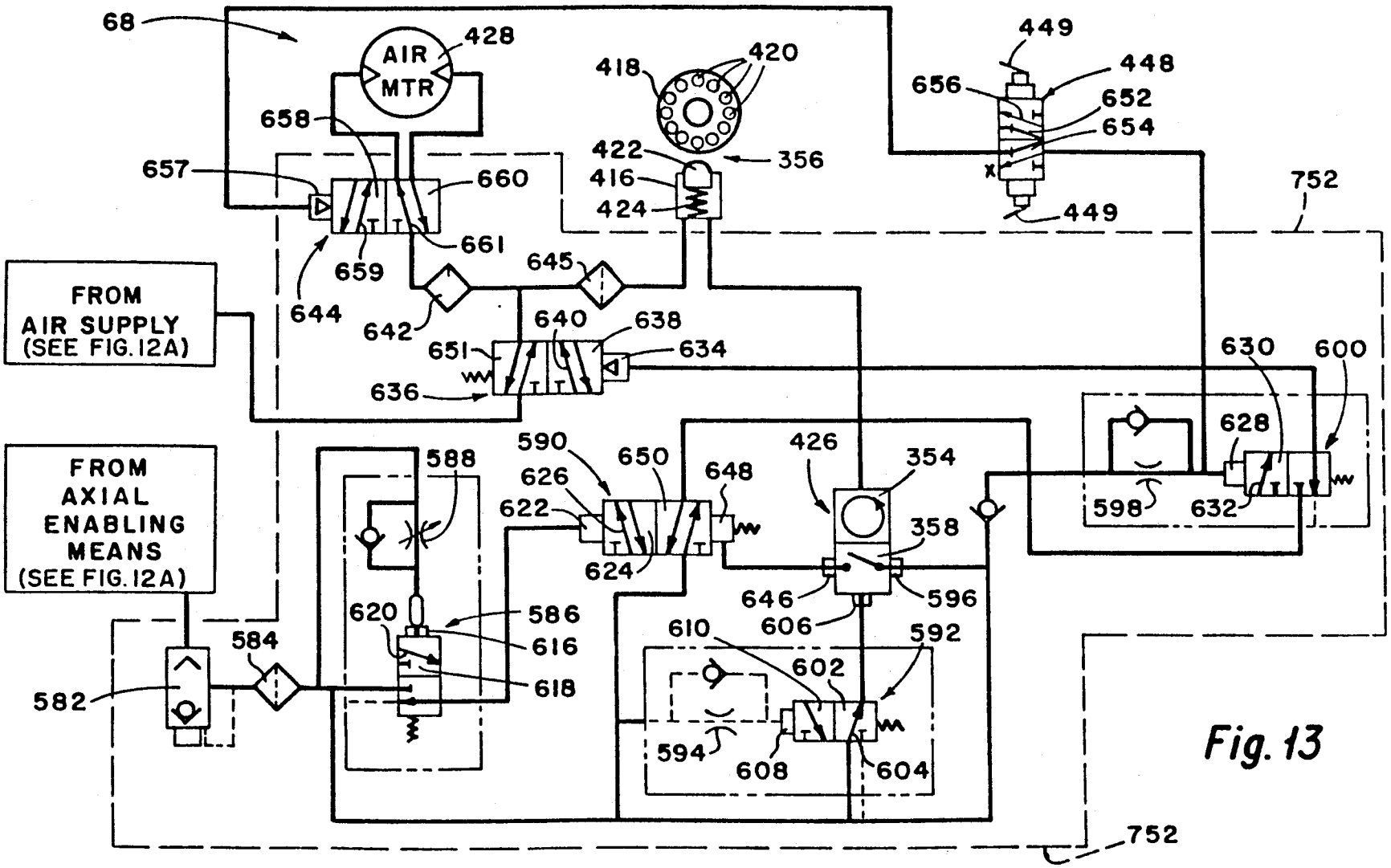
FIG. 13 is a circuit diagram of an embodiment of the transverse drive means of the present invention.

Referring to the example of FIGS. 12 and 13 in the preferred embodiment, the transverse drive means 68 comprises transverse enabling means 352, transverse preselecting means 354, transverse measuring means 356, and transverse disabling means 358. The transverse enabling means 352 is used for enabling the transverse drive means 68 to move the nozzle means 44 when the rotational disabling means 338 disables rotation of the nozzle means 44. The transverse preselecting means 354 is used for preselecting the distance the nozzle means 44 may be moved by the transverse drive means 68 after enablement of the transverse drive means 68. The transverse measuring means 356 is used for measuring the distance the nozzle means 44 is moved by the transverse drive means 68. The transverse disabling means 358 is used for disabling movement of the nozzle means 44 by the transverse drive means 68 when the nozzle means 44 has been moved the preselected distance by the transverse drive means 68.

In the preferred embodiment, referring to the example of FIG. 12A, switch means are provided for preselecting one of the axial drive means 48 and the transverse drive means 68 to move the nozzle means 44 when the rotational drive means 46 is disabled. In the prototype apparatus 20, the transverse enabling means 352 provides the switch means, also designated 352, i.e., the transverse enabling means 352 is used to preselect either the axial drive means 48 or the transverse drive means 68. The preferred apparatus 20 also comprises reenabling means 364 for reenabling the disabled rotational drive means 46 to rotate the nozzle means 44 after the one of the axial drive means 48 and the transverse drive means 68 preselected by the switch means 362 has moved the nozzle means 44 the preselected distance and is disabled. In the prototype, the reenabling means 364 reenables the disabled rotational drive means 46 to rotate the nozzle means 44 a preselected period of time after the rotational drive means 46 is disabled, as further discussed below.

In the preferred embodiment, the rotational drive means 46, axial drive means 48, and transverse drive means 68 are implemented using pneumatically operated components; primarily because of the wet, corrosive atmosphere of a cyclone burner 22. It is recognized that electronic, electrical, computer, hydraulics, and combinations thereof may be used to implement the drive means 46, 48, 68 of the present invention. To facilitate and simplify the following description, pneumatic components are discussed although it is intended to be understood that other forms of circuitry may be used.

Referring to the example of FIG. 12A, in the prototype rotational drive means 46, the rotational enabling means 332 is the source of a pilot signal, also designated 332, which is used to enable the rotational drive means 46, as further discussed below. The rotational enabling means 332 may take any form of switch, solenoid, or power source which will enable the rotational drive means 46.

In the prototype rotational drive means 46, the rotational counting means 336 includes a ball actuated, spring return limit valve 378 and rotational counting plate 380. The rotational counting plate 380 is mounted on the cleaning apparatus 20 so that it rotates with the nozzle means 44. Preferably, the counting plate 380 is mounted on the conduit means 42 and, in the prototype, the rotational counting plate is mounted so that it rotates one revolution with each revolution of the conduit means 42 and nozzle means 44. The rotational counting plate 380 is perforated, and preferably has one perforation 382 which engages the rotational counting valve 378 once with each revolution of the nozzle means 44 and counting plate 380. The ball actuator 384 of rotational counting valve 378 rides on the counting plate 380. When the ball actuator 384 encounters perforation 382, the spring 386 shifts the ball actuator 384 which allows the rotational counting valve 378 to send a pneumatic pulse to the rotational preselecting means 334. The prototype counting valve 378 supplies a pneumatic signal of positive pressure to the rotational preselecting means 334 as long as the ball actuator 384 is in contact with the surface of the counting plate 380 and removes or exhausts the positive pressure of the pneumatic signal to the rotational preselecting means 334 when the ball actuator 384 encounters perforation 382. The prototype rotational counting valve 378 is manufactured by Festo and identified as Model No. SDK-3-PK-3.

Referring to the example of FIG. 12A, in the prototype rotational drive means 46, the rotational preselecting means 334 and rotational disabling means 338 are both components of a pneumatic rotational counter 390, such as is commercially available from Clippard Instrument Labs of Cincinnati, Ohio and identified by the Model No. PC-3PM. The rotational preselecting means 334 is the counter portion, also designated 334, which is a four digit, countdown counter, i.e., up to a four digit number can be preselected and entered into the counter. As the nozzle means 44 rotates and the rotational counting means 336 sends pneumatic pulses to the rotational preselecting means 334, the rotational preselecting means counts down one digit for each pneumatic pulse received. When the rotational preselecting means 334 reaches zero, it enables the rotational disabling means 338 to give a positive pressure pneumatic signal output. The rotational disabling means 338 will continue to give the pneumatic signal output until the rotational preselecting means 334 is reset, as further discussed below.

The rotational drive means 46 also includes rotational drive motor 392 which rotates the nozzle means 44, as further discussed below. The prototype rotational drive motor 392 is an Ingersoll Rand, bidirectional, 0.18 horsepower air motor, identified as Model No. 1440-Q.

Referring to the example of FIG. 12, in the prototype axial drive means 48, the axial enabling means is a pilot operated, spring loaded, two position pneumatic valve, also designated 342. The valve 342 used in the prototype axial drive means 48 is manufactured by MAC Valves, Inc. and identified as Model No. 18001-112-0011.

Referring to the example of FIG. 12, in the prototype axial drive means 48, the axial measuring means 346 includes axial measuring valve 398 and axial counting track 400. The axial measuring valve 398 is a ball actuated, spring return limit valve identical to the rotational counting valve 378. The axial counting track 400 is mounted on the cleaning apparatus 20 so that the axial drive means 48 advances and retracts along the length of the counting track 400 as the nozzle means 44 is axially moved by the axial drive means 48. In the prototype cleaning apparatus 20, the axial counting track 400 is mounted on the beam 172 as further discussed below. The axial measuring valve 398 is mounted on the axial drive means 48 so that the axial measuring valve 398 advances and retracts axially along the length of the axial counting track 400 with the axial drive means 48 and the nozzle means 44. The ball actuator 402 of the axial measuring valve 398 rides on the counting track 400 and when the ball actuator 402 encounters a perforation 404 in the track 400, the spring 406 shifts the ball actuator 402 and enables the axial measuring valve 398 to send a pneumatic signal to the axial preselecting means 344. In the prototype axial measuring means 346, the perforations 404 are located one inch apart along the length of the track 400. Therefore, each pneumatic signal or pulse sent by the axial measuring valve 398 to the axial preselecting means represents one inch of axial motion by the nozzle means 44. The spacing between perforations 404 can be changed, e.g., ¾ inch or 2 inch spacings can be used, to change the axial distance moved by the nozzle assembly for each pneumatic pulse sent to axial preselecting means 344. The prototype axial measuring valve 398 supplies a positive pressure pneumatic signal to the axial preselecting means 344 while the ball actuator 402 is in contact with the track 400 between perforations and removes the pneumatic signal from the axial preselecting means 344 when the ball actuator 402 engages a perforation 404 in the track 400.

In the prototype axial drive means 48, the axial preselecting means 344 and the axial disabling means 348 are components of a single axial pneumatic counter 408. The axial pneumatic counter 408 is identical to the rotational pneumatic counter 390. The axial preselecting means 344 is the counter portion, also designated 344, of the axial counter 408. The axial preselecting means is a four figure, countdown counter, i.e., up to a four digit number can be preselected and entered into the counter. In the prototype cleaning apparatus 20, each digit entered into the axial preselecting means 344 represents one inch of axial travel by the nozzle assembly 44, since perforations 404 are spaced one inch apart. As the axial preselecting means 344 receives pneumatic signals or pulses from the axial measuring valve, the axial preselecting means 344 counts down from the preselected number, i.e., the axial preselecting means counts down one digit for each pneumatic pulse it receives. When the axial preselecting means 344 reaches zero, it enables the axial disabling means 348 to give a positive pressure pneumatic signal output.

The prototype axial drive means includes axial drive motor 410 for moving the nozzle means 44 toward and away from the first end wall 28, as further discussed below. The prototype axial drive motor 410 is an Ingersoll Rand, bidirectional, 0.18 horsepower air motor, identified as Model No. 1440-Q.

Referring to the example of FIG. 12A, in the prototype transverse drive means 68, the transverse enabling means 352 is the source of a pilot signal, also designated 352, which is used to enable the transverse drive means 68, as further discussed below. The transverse enabling means 352 may take any form of switch, solenoid, or power source which will enable the transverse drive means 68.

Referring to the example of FIG. 13, in the preferred embodiment, the prototype transverse measuring means 356 includes transverse measuring valve 416 and transverse counting plate 418. The transverse counting plate 418 is mounted with the transverse drive means 48 so that the transverse counting plate 418 rotates as the nozzle means 44 is moved transversely toward or away from the rotational axis 36 of the nozzle means 44. Preferably, the transverse counting plate 418 is mounted so that it is rotated by the transverse support arms 282 as the nozzle means 44 moves transversely, as further discussed below. The transverse counting plate 418 includes perforations 420 near the circumferential edge of the plate 418. The transverse measuring valve 416 is a ball actuated, spring return limit valve identical to the rotational counting valve 378 and the axial measuring valve 398. The transverse measuring valve 416 is mounted with the transverse drive means 68 so that the ball actuator 422 of the valve 416 rides on the transverse counting plate 418 and engages the perforations 420 as the plate 418 rotates. Similarly to the valves 378, 398, the transverse measuring valve 416 sends a pneumatic signal to the transverse preselecting means 354 as the ball actuator 422 of the valve engages perforations 420. The transverse counting plate 418 should be positively driven by the transverse motion of the nozzle means 44 so that the transverse counting plate 418 is rotated a known distance for each unit of transverse distance moved by the nozzle means 44. For example, the peripheral edge of the transverse counting plate may travel one inch for each inch of transverse travel of the nozzle means 44. The perforations 420 are placed at selected intervals around the plate 418 and therefore each pneumatic signal or pulse from the transverse measuring valve 416 represents a known distance of transverse travel by the nozzle means 44. The prototype transverse measuring valve 416 supplies positive pressure to the transverse preselecting means 354 while the ball actuator 422 is in contact with the transverse counting plate 418 and removes the pneumatic signal when the ball actuator 422 engages a perforation 420. As with the previously discussed valves 378, 398, spring 424 biases the ball actuator 422 into engagement with perforations 420.

In the prototype transverse drive means 68, the transverse preselecting means 354 and transverse disabling means 358 are components of a single pneumatic counter 426. The transverse pneumatic counter 426 is identical to the rotational and axial counters 390, 408 discussed above. The transverse preselecting means 354 is the counter portion of the transverse counter 426 which is a four figure, countdown counter, i.e., up to a four digit number can be preselected and entered into the counter. As the transverse measuring valve sends pneumatic signals or pulses to the transverse preselecting means 354, the transverse preselecting means counts down one digit for each pulse received until it reaches zero, at which time the transverse preselecting means enables the transverse disabling means 358 to give a pneumatic output. In the prototype cleaning apparatus 20, each digit entered into the transverse counter 426 represents one inch of travel by the nozzle assembly 44 in the transverse direction, therefore if the digit 0001 is entered into the transverse counter 426, the transverse drive means 68 will move the nozzle assembly 44 one inch in the transverse direction with each enablement of the transverse drive means 68. If the digit 0002 is entered into the transverse counter 426, the transverse drive means 68 will move the nozzle assembly 44 two inches for each enablement of the transverse drive means 68, etc.

In the preferred embodiment, referring to the example of FIG. 13, the transverse drive means 48 includes transverse drive motor 428 for driving the nozzle means 44 transversely toward or away from the rotational axis 36, as further discussed below. The prototype transverse drive motor 428 is an Ingersoll Rand, bidirectional, 0.18 horsepower air motor, identified as Model No. 1440-Q.

In the preferred embodiment, the axial drive means 48 moves the nozzle means 44 axially between a first axial position 432 (best seen in FIG. 15), nearer the first end wall 28 and a second axial position 434, nearer the second end wall 32. Referring to the example of FIG. 12A, the axial drive means 48 includes axial reversing means 436 for automatically reversing the axial motion of the nozzle means 44 when the nozzle means 44 reaches the first axial position 432 and when the nozzle means 44 reaches the second axial position 434. In the prototype axial drive means 48, the axial reversing means 436 is a four-way, double plunger, air valve having a plunger 437 extending from each side of the valve. The prototype axial reversing means 436 is manufactured by Clippard Instrument Labs and identified as Model No. FV-4D. As will be further discussed below, in the prototype cleaning apparatus 20, the axial drive means 48 travels along the beam 172 between the first end 174 and second end 176 of the beam in order to move the nozzle means 44 axially between the first axial position 432 and the second axial position 434. Referring to the example of FIG. 17, in the prototype, the axial reversing means 436 is mounted on the axial drive means 48. A first axial stop 438 is mounted near the beam first end 174 and a second axial stop 440 (best seen in FIG. 1) is mounted near the beam second end 176. The first and second axial stops 438, 440 are mounted in the path of travel of the axial reversing means 436 so that as the axial reversing means approaches one of the stops 438, 440, one of the plungers 437 of the axial reversing means 436 contacts the stop 438, 440 which reverses the axial motion of the nozzle means 44, as further discussed below.

Figure 19:
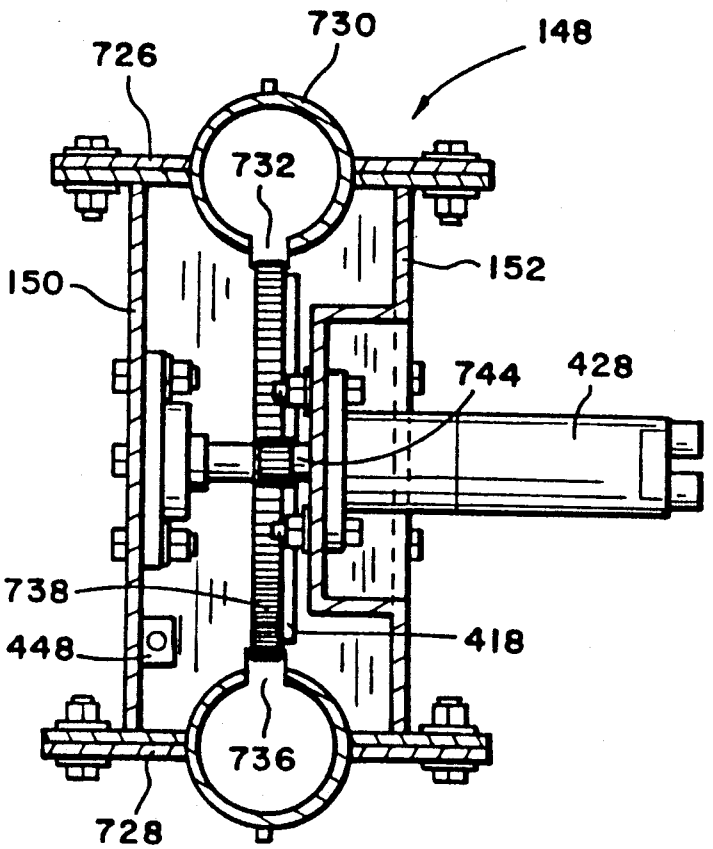
FIG. 19 is a sectional view taken along line 19—19 of FIG. 5, the nozzle assemblies being omitted for clarity.

In the preferred embodiment, the transverse drive means 68 moves the nozzle means 44 transversely between a first transverse position 444 (best seen in FIG. 14), nearer the rotational axis 36, and a second transverse position 446, nearer the chamber side wall 26. In the preferred embodiment, referring to the example of FIG. 13, the transverse drive means 68 comprises transverse reversing means 448 for automatically reversing the transverse motion of the nozzle means 44 when the nozzle means 44 reaches the first transverse position 444 and when the nozzle means 44 reaches the second transverse position 446. In the prototype transverse drive means 68, the transverse reversing means 448 is a four-way, double plunger, air valve having a plunger 449 extending from each end of the valve, and is identical to the axial reversing means 436. As will be further discussed below, in the prototype cleaning apparatus 20, the transverse drive means 68 transversely extends and retracts the transverse support arms 282 in order to move the nozzle means 44 transversely toward and away from the rotational axis 36. Preferably, the transverse reversing means 448 is mounted on the transverse drive means 68 adjacent the path of travel of one of the transverse support arms 282, as best seen in FIG. 19. Referring to FIG. 5, a first transverse stop 450 is connected near the first end 283 of the transverse support arm 282. A second transverse stop 452 is connected to the transverse support arm 282 near the second end 284 of the support arm 282. As the support arm 282 moves the nozzle means 44 from the first transverse position 444 to the second transverse position 446, the first and second transverse stops 450, 452 contact one of the plungers 449 of the transverse reversing means 448 to reverse the transverse motion of the nozzle means 44, as further discussed below.

FIGS. 12 and 13 present a preferred embodiment of the circuitry used to implement the rotational drive means 46, axial drive means 48, and transverse drive means 68. Referring to the example of FIG. 12, to initiate operation of the prototype cleaning apparatus 20, a pneumatic signal (or equivalent if electrical, hydraulic, or other circuitry is used) is applied to the cleaning apparatus 20 from air supply 460 by opening valve 461, which may also be a switch or similar device as is known in the art. The pneumatic signal passes to the transverse drive means 68 through first swivel 76 and signal conducting means 120 (best seen in FIG. 1), as further discussed below. The pneumatic signal from air supply 460 is also applied to valve 462 and valve 464. Valve 464 is initially in its spring position 466 and therefore the pneumatic signal passes through port 468 and through check valve 470 to the reset port of rotational counter 390. The application of the pneumatic signal to the reset port 472 resets the rotational disabling means 338 and rotational preselecting means 334. The pneumatic signal from valve 464 also passes through check valve 474 to the reset port 476 of axial counter 408. The presence of the pneumatic signal at reset port 476 resets the axial disabling means 348 and axial preselecting means 344. After a preselected period of time determined by restriction orifice 478 (approximately 0.3–0.5 minutes in the prototype cleaning apparatus 20), the pneumatic signal is applied to the pilot 480 of valve 464 which shifts valve 464 to its pilot position 482 and removes the pneumatic signal from check valves 470, 474 and from reset ports 472, 476. In the preferred embodiment, the restriction orifice 478 is an integral component of valve 464 which is available from Clippard Instrument Labs and identified as Model No. R333, and is representative of the time delay valves used with the prototype cleaning apparatus 20.

In order to start rotation of the nozzle means 44, the rotational enabling means 332 is used to apply a pneumatic signal to the pilot 484 of valve 462. The pneumatic signal from rotational enabling means 332 shifts valve 462 to its pilot position 486 which allows the pneumatic signal from the air supply 460 to pass through port 488 of valve 462. Valve 462 is a pilot operated air valve. The valve 462 used in the prototype apparatus 20 is available from MAC Valves, Inc. and identified as Model No. 180-01-112-0011. Valve 462 is representative of the pilot operated air valve used with the prototype cleaning apparatus 20.

After passing through port 488 of valve 462, the pneumatic signal is applied to valve 490, valve 492, and to the pressure port 494 of rotational counter 390. The pneumatic signal deadends at the pressure port 494 and valve 492. Valve 490 should be in its spring position 496 (since rotational counter 390 has been reset) and the pneumatic signal passes through port 498 to rotational drive motor 392 and rotational counting valve 378. The pneumatic signal to the rotational drive motor 392 rotates nozzle means 44 (FIG. 1) and therefore rotational counting plate 380. With each rotation of plate 380, the rotational measuring valve 378 sends a pneumatic pulse to rotational preselecting means 334. The rotational preselecting means 334 uses the pneumatic pulses to count down from the preselected number entered in the rotational preselecting means 334. When the rotational preselecting means 334 counts down to zero, the rotational disabling means 338 allows the pneumatic signal at pressure port 494 of the rotational counter 390 to pass through exhaust port 500 of the rotational counter 390, through port 502 of valve 492 to the pilot 504 of valve 490. The pneumatic signal at pilot 504 shifts valve 490 to its pilot position 506 which allows the pneumatic signal to pass through port 508 to axial enabling means 342 and to reenabling means 364 and also disconnects the pneumatic signal through valve 490 to the rotational drive motor 392 which stops rotation of the nozzle means 44. Reenabling means 364, which is a pilot operated valve, also designated 364, is in its spring position 510 so the pneumatic signal deadends at valve 364.

The axial enabling means 342 of the prototype cleaning apparatus 20 is a pilot operated valve, also designated 342. When the axial enabling means 342 is in its spring position 512, it enables the axial drive means 48 to move the nozzle means 44. When the axial enabling means 342 is in its pilot position 514, i.e., when it is receiving a pilot signal from the transverse enabling means 352, the transverse drive means 68 is enabled.

Assuming for purposes of discussion that the axial enabling means 342 is in its spring position 512, the pneumatic signal from port 508 of valve 490 passes through port 516 of axial enabling means 342 to valve 518, axial reversing means 436, pressure port 520 of axial counter 408 and to valve 522. The pneumatic signal deadends at pressure port 520 and valve 522.

Valve 518 should be in its spring position 524 and the pneumatic signal passes through port 526 to axial measuring valve 398 and through valve 528 to axial drive motor 410. The axial drive motor 410 receives the pneumatic signal and drives the nozzle means 44 axially. As the axial drive motor 410 moves the nozzle means 44 axially, the axial measuring valve 398 moves along axial counting track 400. As the axial measuring valve 398 engages perforations 404 in the axial counting track 400, the axial measuring valve 398 sends pneumatic pulses to axial preselecting means 344.

When the nozzle means 44 reaches the first or second axial position 432, 434 (best seen in FIG. 15), the axial reversing means 436 will contact one of the first or second axial stops 438, 440 (best seen in FIG. 1) which will shift the axial reversing means 436 from a first position 534 to a second position 536 or vice versa. Assuming the axial reversing means 436 has encountered a stop 438, 440 and has shifted to the first position 534, the pneumatic signal from axial enabling means 342 passes through port 538 to pilot 540 of valve 528 which shifts valve 528 to its pilot position 542 and applies the pneumatic signal to the axial drive motor 410 through port 544 in order to reverse the direction of the axial drive motor 410. The axial drive motor 410 will then drive the nozzle assembly 44 in the new axial direction until the axial reversing means 436 encounters the other stop 438, 440 which will shift the axial reversing means to second position 536 and remove the pneumatic signal from pilot 540. Valve 528 will then shift to spring position 545 and pass the pneumatic signal through port 547 to reverse the axial drive motor 410.

The axial drive motor 410 will continue to drive the nozzle means 44 axially until the axial preselecting means 344 counts down to zero (normally one inch of axial motion). When the axial preselecting means 344 reaches zero, the axial disabling means 348 connects pressure port 520 to exhaust port 546 allowing the pneumatic signal to pass through valve 522 to the pilot 548 of valve 518. Pilot 548 then shifts valve 518 to its pilot position 550 which disconnects the pneumatic signal to the axial drive motor 410 and disables axial motion of the nozzle means 44. The nozzle means 44 and cleaning apparatus 20 will remain disabled until the variable restriction orifice 554 allows the pneumatic signal to access pilot 556 of reenabling means 364. This shifts reenabling means 364 to its pilot position 558, which allows the pneumatic signal to pass through port 560 of reenabling means 364, through check valve 470, to reset port 472 of rotational counter 390, resetting the rotational disabling means 338 and rotational preselecting means 334. This breaks communication between pressure port 494 and exhaust port 500 which removes the pneumatic signal from pilot 504 of valve 490, which allows valve 490 to shift to its spring position 496, which removes the pneumatic signal from axial enabling means 342 and valve 518 and applies the pneumatic signal to the rotational drive motor 392 through port 498, thereby starting rotation of the nozzle means 44 in a new axial position.

In the preferred embodiment, the variable restriction orifice 554 is an integral component of reenabling means 364. Reenabling means 364 is preferably a time delay valve available from Clippard Instrument Labs and identified as Model No. R-333, and is also representative of the variable time delay valves used with the prototype cleaning apparatus 20. The variable restriction orifice 554 should be adjusted to allow adequate time for the axial drive means 48 (or the transverse drive means 68, as further discussed below) to be enabled, to move the nozzle assembly 44 the desired axial distance, to be disabled, and to reset the axial preselecting means 344 and axial disabling means 348. The variable restriction orifice 554 should not be adjusted to require an excessive amount of time to shift reenabling means 364 to its pilot position 558, since doing so will increase the amount of time the cleaning apparatus 20 is disabled and therefore affect the efficiency of the apparatus 20.

In the prototype cleaning apparatus 20, the axial preselecting means 344 is adjusted to advance the nozzle means 44 axially one inch with each enablement of the axial drive means 48, i.e., each time the rotational drive means 46 runs its preselected number of rotations, is disabled, and enables the axial drive means 48. The cleaning apparatus 20 will remain in this mode, i.e., rotating the nozzle means 44, disabling rotation, moving the nozzle means 44 axially, disabling axial motion, rotating the nozzle means 44, etc. until transverse enabling means 352 is manually positioned or switched to shift axial enabling means 342 to its pilot position 514 and allows enablement of the transverse drive means 68 rather than the axial drive means 48; or until the rotational drive means 46 is disabled by removing the air supply signal through valve 461 or removing the signal from the rotational enabling means 332.

When it is desired to move the nozzle means 44 transversely, transverse enabling means 352 is manually positioned to enable the transverse drive means 68. The prototype transverse enabling means 352 is a source of a pneumatic signal, such as a switch, valve, etc. and is used to apply a pneumatic signal to pilot 572 of axial enabling means 342. The application of the signal from the transverse enabling means 352 to pilot 572 shifts the axial enabling means 342 to pilot position 514. As previously discussed, when the rotational drive means 46 has been enabled and has rotated its preselected number of rotations, the rotational disabling means 338 shifts valve 490 to pilot position 506 allowing the pneumatic signal to pass through port 508 of valve 490 to the axial enabling means 342. Since the transverse enabling means 352 has shifted the axial enabling means 342 to its pilot position 514, the pneumatic signal from valve 490 passes through port 574 to the transverse drive means 68.

The pneumatic signal from port 574 of the axial enabling means 342 passes through signal conducting means 120, first swivel 76, and elongate hollow member 126 to the transverse drive means 68 (best seen in FIG. 1). Referring now to the example of FIG. 13, when the pneumatic signal from port 576 of the axial enabling means 342 reaches the transverse drive means 68, it first passes through quick exhaust valve 582 (which allows the pneumatic signal to exhaust when the transverse drive means 68 is disabled) and filter 584. The quick exhaust valve 582 used in the prototype apparatus is available from Clippard Instrument Labs and identified as Model No. MEV-2. From filter 584, the pneumatic signal is applied to valve 586, variable restriction orifice 588 (which is an integral part of valve 586 in the preferred embodiment), valve 590, valve 592 and restriction orifice 594 (which is an integral part of valve 592 in the preferred embodiment), pressure port 596 of transverse counter 426, and to restriction orifice 598 (which is an integral part of valve 600 in the preferred embodiment).

Since valve 592 is initially in its spring position 602, the pneumatic signal passes through port 604 to the reset port 606 of transverse counter 426 which resets the transverse preselecting means 354 and the transverse disabling means 358. Restriction orifice 594 delays application of the pneumatic signal to the pilot 608 of valve 594 long enough for the radial counter 426 to be reset and then allows the pneumatic signal to reach pilot 608 and shift valve 592 to its pilot position 610 which disconnects the pneumatic signal from the reset port 606 of the transverse counter 426.

Initially, the pneumatic signal deadends at valve 586. Restriction orifice 588 delays application of the pneumatic signal to the pilot 616 of valve 586 until the radial counter 426 is reset. Once sufficient pneumatic signal pressure has passed through restriction orifice 588 to shift valve 586 to its pilot position 618, the pneumatic signal passes through port 620 to pilot 622 of valve 590. The presence of the pneumatic signal at pilot 622 shifts valve 590 to its pilot position 624 which allows the pneumatic signal to pass through port 626 to valve 600. Once restriction orifice 598 allows sufficient pneumatic signal pressure to build at pilot 628, valve 600 shifts to its pilot position 630 and allows the pneumatic signal to pass through port 632 to pilot 634 of valve 636. Pilot 634 shifts valve 636 to its pilot position 638 which allows the pneumatic signal from air supply 460 (via first swivel 76) to pass through port 640, lubricator 642 and valve 644 to transverse drive motor 428; and through filter 645 to transverse measuring valve 416.

The transverse drive motor 428 uses the pneumatic signal as a driving force which rotates the motor 428. The motor 428, in turn, transversely extends and retracts the transverse support arms 282 to transversely move the nozzle means 44. As the transverse drive motor 428 drives the nozzle means 44, it also rotates transverse counting plate 418. As transverse counting plate 418 rotates, the transverse measuring valve 416 engages the perforations 420 in the transverse counting plate 418 and sends pneumatic impulses to the transverse preselecting means 354. As the transverse preselecting means 354 receives pneumatic pulses from transverse measuring valve 416, it counts down from its preselected starting number. When the transverse preselecting means 354 counts down to zero, the transverse disabling means 358 allows the pneumatic signal at the pressure port 596 of the transverse counter 426 to pass through exhaust port 646 to the pilot 648 of valve 590. The pneumatic signal at pilot 648 shifts valve 590 to its spring position 650 which disconnects the pneumatic signal through port 626 and valve 600 to the pilot 634 of valve 636. This results in valve 636 shifting to its spring position 651 and disconnecting the pneumatic signal to transverse drive motor 428 and transverse measuring valve 416, thereby disabling the transverse drive means 68.

Referring to FIG. 12, the transverse drive means 68 and cleaning apparatus 20 will then remain disabled until the restriction orifice 554 of reenabling means 364 passes enough pneumatic signal pressure to pilot 556 to shift reenabling means 364 to its pilot position 558, which allows the pneumatic signal to pass through port 560 of reenabling means 364, through check valve 470, to reset port 472 of rotational counter 390, resetting the rotational disabling means 338 and rotational preselecting means 334. This, in turn, removes the pneumatic signal from pilot 504 of valve 490, which allows valve 490 to shift to its spring position 496, which removes the pneumatic signal from the port 574 of axial enabling means 342 and applies the pneumatic signal to the rotational drive motor 392 through port 498 of valve 490, thereby starting rotation of the nozzle means 44 in a new transverse position. As previously discussed, the variable restriction orifice 554 should be adjusted to allow sufficient time for the transverse drive means 68 (or the axial drive means 48, as discussed above) to be enabled, to move the nozzle assembly 44 the desired distance, to be disabled, and to be reset.

Referring to example FIG. 13, in the prototype cleaning apparatus 20, the transverse preselecting means 354 is adjusted to advance the nozzle means 44 transversely one inch with each enablement of the transverse drive means 68, i.e., each time the rotational drive means 46 runs its preselected number of rotations, is disabled, and enables the transverse drive means 68. The cleaning apparatus 20 will remain in this mode, i.e., rotating the nozzle means 44, disabling rotation, moving the nozzle means 44 transversely, etc. until the pneumatic signal from the transverse enabling means 352 is removed from pilot 572 of axial enabling means 342, which shifts axial enabling means 342 to its spring position 512 and allows enablement of the axial drive means 48 rather than the transverse drive means 68; or until the cleaning apparatus 20 is disabled.

While the transverse drive means 68 is enabled, when the nozzle means 44 reaches the first or second transverse position 444, 446 (best seen in FIG. 14), the transverse reversing means 448 will contact one of the first or second transverse stops 450, 452 (best seen in FIG. 5) which will shift the transverse reversing means 448 from a first position 652 to a second position 654 or vice versa. Assuming the transverse reversing means 448 has encountered a stop 450, 452 and has shifted to the first position 652, the pneumatic signal from restriction orifice 598 passes through port 656 of the transverse reversing means 448 to pilot 657 of valve 644, which shifts valve 644 to its pilot position 658 and allows the pneumatic signal from valve 636 to pass through port 659 to the transverse drive motor 428 in order to reverse the direction of the transverse drive motor 428. The transverse drive motor 428 will then drive the nozzle assembly 44 in the new transverse direction until the transverse reversing means 448 encounters the other stop 450, 452 which will shift the transverse reversing means 448 to second position 654 and remove the pneumatic signal from pilot 657 of valve 644. Valve 644 will then shift to spring position 660 and pass the pneumatic signal through port 661 to reverse the transverse drive motor 428.

Referring to example FIG. 12, rotational counter reset 662 may be used to manually reset the rotational preselecting means 334 and the rotational disabling means 338. Manually activating the rotational counter reset 662 shifts valve 492 to its pilot position 663 which allows the pneumatic signal from port 488 of valve 462 to pass through port 664 of valve 492. The pneumatic signal passes from valve 492 to the pilot 504 of valve 490, shifting valve 490 to its pilot position 506 which allows the pneumatic signal to pass through port 508 of valve 490 to the axial enabling means 342 and to the reset port 494 of rotational counter 390. It should be noted that operating the rotational counter reset 662 will also disable the rotational drive means 46 and enable the one of the axial drive means 48 or the transverse drive means 68 selected by the transverse enabling means 352. The rotational counter reset 662 used with the prototype cleaning apparatus 20 is available from Clippard Instrument Labs and identified as Model No. MTV5.

Axial counter reset 666 may be used to manually reset the axial preselecting means 344 and axial disabling means 348. Manually activating the axial counter reset 552 shifts valve 522 to its pilot position 667. Assuming the transverse enabling means 352 is positioned to select the axial drive means 48 for enablement and that the rotational drive means 46 is sending a pneumatic signal to axial enabling means 342, the pneumatic signal from the rotational drive means 46 will pass through port 516 of axial enabling means 342 and through port 668 of valve 522 to the pilot 548 of valve 518. This will shift valve 548 to its pilot position 550 and allow the pneumatic signal from the axial enabling means to pass through port 669 of valve 518 and through valve 671 to reset the axial counter 408. It should be noted that activating the axial counter reset 552 will also disable the axial drive means 48. Restriction orifice 673 delays application of the pneumatic signal to the pilot 675 of valve 671 long enough for the axial counter 408 to be reset. The restriction orifice 673 then allows the pneumatic signal to reach pilot 675 and shift valve 671 to its pilot position 677 which disconnects the pneumatic signal from the reset port 476 of the axial counter 408. The axial counter reset 666 is identical to the rotational counter reset 662.

Figure 16:
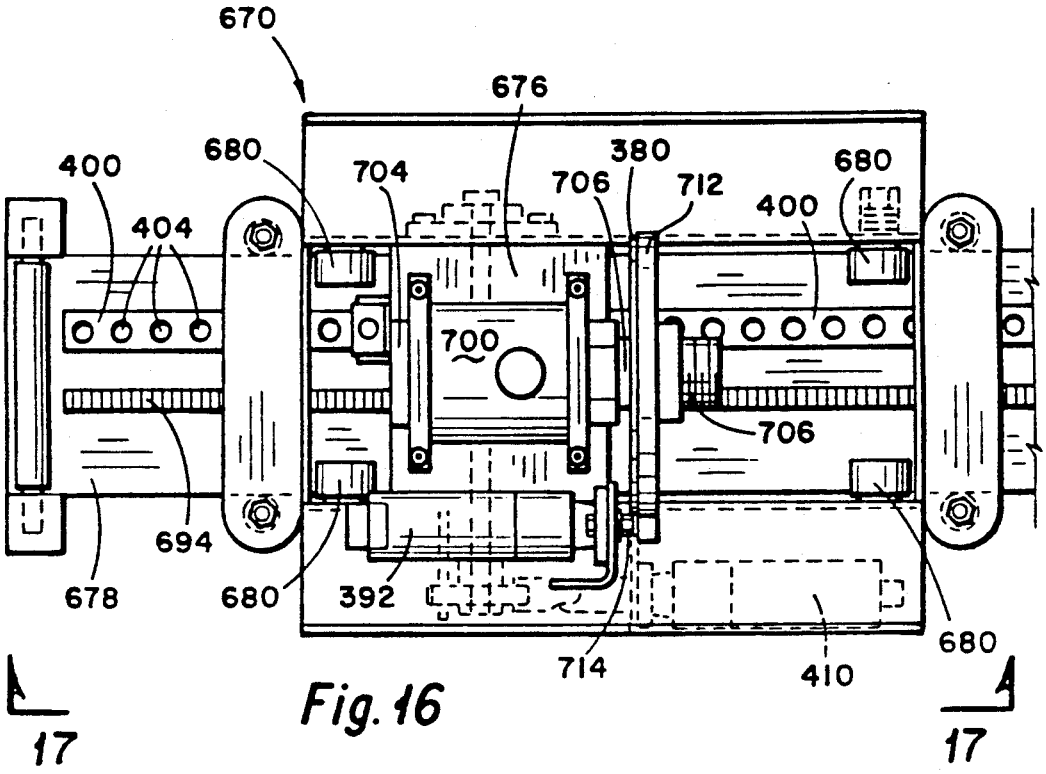
FIG. 16 is a plan view of an embodiment of the carriage and an embodiment of the first end of the beam of the present invention.
Figure 17:
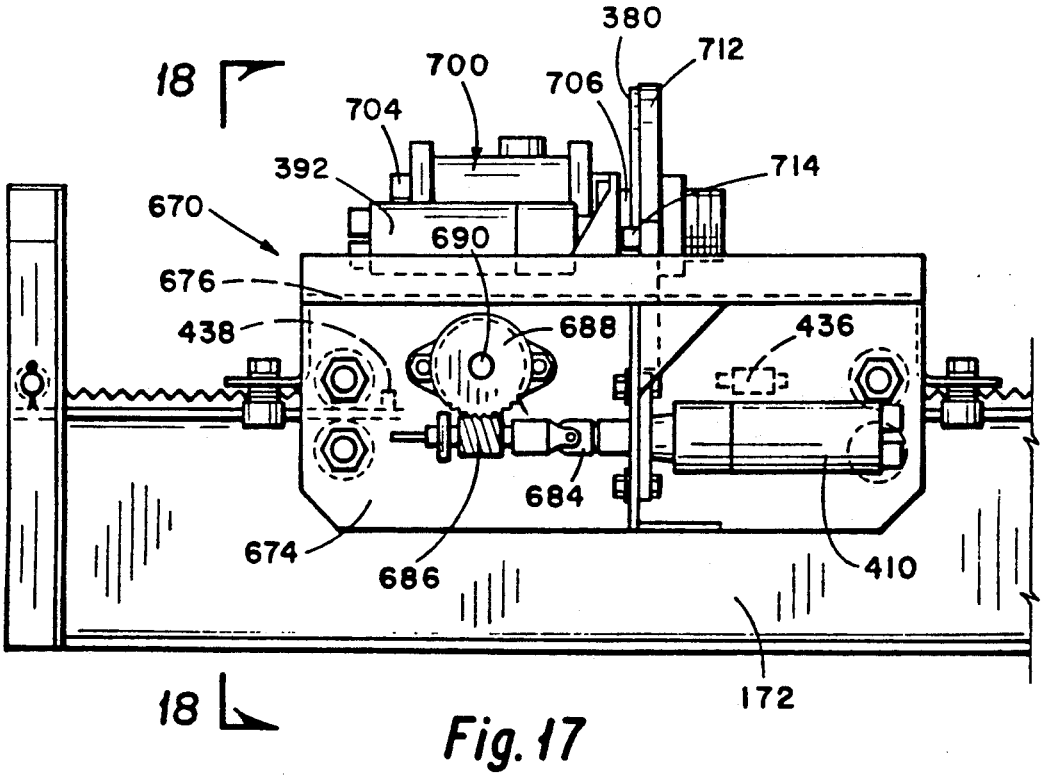
FIG. 17 is an elevational view taken along line 17—17 of FIG. 16.
Figure 18:
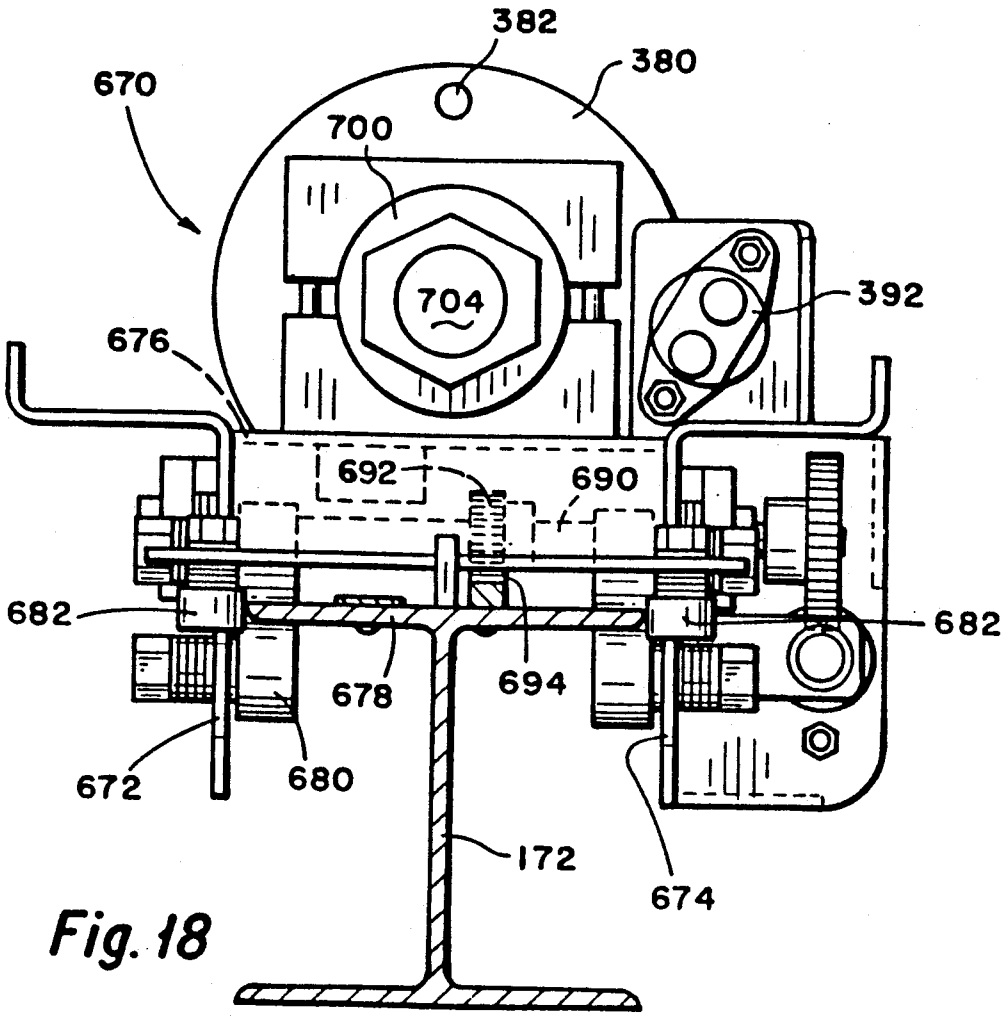
FIG. 18 is an end view taken along line 18—18 of FIG. 17.

Referring to the example of FIGS. 16-18, in the preferred embodiment, the cleaning apparatus 20 includes a carriage, generally designated 670. Also, in the preferred embodiment, the beam 172 is a commercially available I-beam. Referring to the example of FIG. 18, the preferred carriage 670 includes generally vertical walls 672, 674 on either side of the beam 172 and a generally horizontal platform 676 near the top of the walls 676 and spaced above the top flange 678 of I-beam 172. A plurality of rollers 680 having horizontal rotational axes are mounted on the carriage walls 672, 674 for vertically supporting the carriage 670 from the top flange 678 of beam 172 and for slidably or rollingly engaging the carriage 670 with the beam 172. In the prototype carriage 670, four rollers 680 are mounted on each carriage wall 672, 674. A plurality of rollers 682 having vertical rotational axes, or similar guiding devices, are connected to each side wall 672, 674 at both ends of each side wall for maintaining proper horizontal alignment of the carriage 670 with respect to the beam 172. In the prototype carriage 670, two rollers 682 are located at each axial end of the carriage 670.

As exemplified in FIGS. 16 and 17, in the prototype, the axial drive motor 410 is mounted on wall 674 of the carriage 670. Axial drive motor 410 has a drive shaft 684 rotatably connected to worm gear 686. Worm gear 686 meshes with gear 688 which turns shaft 690 to rotate axial pinion 692. Referring to FIG. 18, axial pinion 692 engages axial rack 694 which is mounted on the top surface of top flange 678. The axial rack 694 extends axially on the beam 172, i.e., it extends parallel to or coaxial with the longitudinal axis 36 of chamber 22, as exemplified in FIG. 16. Thus, the axial drive motor 410, which is a reversible pneumatic motor, turns the axial pinion one direction to advance the carriage 670 axially toward the chamber 22 and turns the axial pinion 692 the other way to move the carriage 670 axially away from the chamber 22.

Second swivel 700 is mounted on the carriage platform 676. The second swivel 700 used with the prototype cleaning apparatus is available from Stoneage, Inc. of Durango, Colo. and is identified as Model No. OQ. The fluid conducting conduit 702 (best seen in FIG. 1) is connected to the fluid inlet connection 704 of the second swivel 700. Second swivel inlet 704 puts the conduit 702 in fluid communication with the rotatable inner sleeve 706 of the second swivel 700. The inner sleeve 706 extends from the outer body 708 of the second swivel 700 axially towards the chamber 22. A threaded coupling (not illustrated) couples the inner sleeve 706 to the conduit means 42. Rotational spur gear 712 and rotational counting plate 380 are coaxially mounted on the outside surface of the inner sleeve 706 of second swivel 700. Rotational drive motor 392 is mounted on the carriage platform 676 and has a drive shaft 714 rotatingly connected to a gear (not illustrated) which engages rotational spur gear 712 in order to rotatingly drive the rotational spur gear 712 thereby rotating the second swivel inner sleeve 706 and the conduit means 42. Although not illustrated, the rotational counting valve 378 is mounted on the carriage 670 with the ball actuator 384 of the valve 378 positioned for engagement with the perforation 382 in the rotational counting plate 380, as previously discussed.

Referring to the example of FIG. 16, in the preferred embodiment, the axial counting track 400 extends axially along the top surface of the top flange 678 of beam 172. Preferably, the axial counting track 400 extends parallel to the axial rack 694. Although not illustrated, the axial measuring valve 398 is mounted on the carriage so that the ball actuator 402 of the valve 398 engages the perforations 404 in the track 400 as the carriage 670 moves axially on beam 172. Also in the preferred embodiment, the axial reversing means 436 is mounted on carriage 670, as exemplified in FIG. 17. The first axial stop 438 and second axial stop 440 are mounted on beam 172 so that the axial reversing means 436 contacts the first axial stop 438 when the nozzle means is in the first axial position 432 and the axial reversing means 436 contacts the second axial stop 440 when the nozzle means is in the second axial position 434, as best exemplified in FIG. 1.

Referring to the example of FIG. 1, the preferred cleaning apparatus 20 also includes a master control panel 720 which is placed in a location away from the chamber 22 and the moving portions of the cleaning apparatus 20. In the preferred embodiment, the transverse enabling means 352, rotational enabling means 332, and air supply 460 are located in the master control panel 720. Master conduit 722, which contains a plurality of pneumatic tubes, carries pneumatic signals from the master control panel 720 to rotational control housing 724. In the preferred embodiment, the rotational control housing 724 houses valves and counters associated with the rotational drive means 46 and axial drive means 48, as illustrated by the dashed line in FIG. 12. As best seen in FIG. 1, the rotational control housing 724 is mounted on carriage 670 and straddles the second swivel 700.

Referring to the example of FIG. 1, in the preferred embodiment, the first segments 122 of the signal conducting means 120 are connected from the rotational control housing 724 (which houses portions of the rotational drive means 46) to the first end 88 of the outer passageway 86 of the outer sleeve body 78 of first swivel 76 (best seen in FIG. 3).

The rotational drive motor 392 rotates rotational spur gear 712 and the inner sleeve 706 of the second swivel 700 to rotate the conduit means 42, inner sleeve body 80 of first swivel 76, elongate hollow member 126, spacer 132, and indexing body 148.

As also previously discussed, the indexing body 148 is connected to the second end 136 of spacer 132. Referring to the example of FIGS. 1, 5, and 19, in the preferred embodiment, the indexing body 148 has a first side 150 connected to the second end 136 of spacer 132 and the indexing body 148 has a second side 152 spaced away from the first side 150 and facing the opposite direction, i.e., facing the second end wall 32 of chamber 22. The preferred indexing body 148 also includes a top plate 726 connected across the top of the indexing body sides 150, 152 and a bottom plate 728 connected across the bottom ends of indexing body sides 150, 152. The top and bottom plates 726, 728 in the preferred embodiment are bolted to the sides 150, 152 to form a rectangular structure. The top plate 726 includes a first bearing tube 730 which slidably receives the first end 283 of nozzle support arm 282. The lower portion of the first bearing tube 730, i.e., the lowest portion inside the indexing body 148, has an open slot 732. The bottom plate 728 includes a second bearing tube 734 for slidably receiving the first end 283 of nozzle support arm 282. The second bearing tube 734 has a slot 736 facing into the indexing body 148. Transverse spur gear 738 is journaled between the first and second sides 150, 152 of the indexing body 148 so that the teeth of the spur gear 738 extend into the slots 732, 736 of the bearing tubes 730, 734 and so that the spur gear 738 rotates about a rotational axis generally parallel to or coaxial with the longitudinal axis 36 of chamber 22. The first ends 283 of the nozzle support arms 282 have a rack 742, best seen in FIG. 5, and the support arms 282 are positioned in the bearing tubes 730, 734 so that the racks 742 extend through the slots 732, 736 and engage the teeth 740 of the transverse spur gear 738. In the prototype, the nozzle support arms 282 are driven simultaneously and equidistantly by the transverse spur gear 738.

Transverse counting plate 418 is journaled in indexing body 148 coaxially with transverse spur gear 738. Although not illustrated, transverse measuring valve 416 should be mounted to the indexing body 148 so that the ball actuator 422 engages counting plate perforations 420 as the counting plate rotates with transverse spur gear 738.

Transverse drive motor 428 is connected to the indexing body 148 so that the drive shaft 744 (with appropriate gearing) engages the teeth 740 of transverse spur gear 738. Preferably, the transverse drive motor 428 extends through the second side 152 of the indexing body 148. The transverse drive motor 428 is a reversible pneumatic motor which can rotate transverse spur gear 738 in either direction in order to transversely extend and retract nozzle assemblies 44. Transverse reversing means 448 is mounted to the indexing body 148 adjacent one of the bearing tubes 730, 734 so that the transverse reversing means 448 will contact the first and second transverse stops 450, 452 as the nozzle support arm 282 is extended and retracted, as previously discussed.

As previously discussed, referring to FIG. 1, support member 154 extends axially from the second side 152 of indexing body 148 through the outlet opening 34 of chamber 22. Transverse control housing 752, best seen in FIG. 1, is connected to the second side 152 of the indexing body 148 and straddles or surrounds the support member 154. As exemplified by dashed line 752 in FIG. 13, in the preferred embodiment the transverse control housing 752 houses the pilot valves, transverse counter, and related components of the transverse drive means 68. As best seen in FIG. 1, the second segments 124 of signal conducting means 120 are connected from the second end 100 of the inner passageway 96 of the inner sleeve body 80 of first swivel 76 through the hollow elongate member 126 to the transverse control housing 752.

In the prototype cleaning apparatus 20, the rotational and axial counter resets 662, 666, rotational enabling means 332, transverse enabling means 352, and air supply valve 461 are located in the master control panel 720. The master control panel 720 is intended to be used to remotely position the nozzle assembly 44 and to initiate automatic operation. It should contain a filter regulator (not illustrated) for air preparation as well as all equipment necessary to control on/off functions and to regulate air pressure and automatic operations. The master control panel 720 should include a manual override switch (not illustrated) which allows the cleaning apparatus 20 to be switched from automatic to manual operation.

The rotational control housing 724 contains all of the pneumatic logic components necessary to control axial positioning of the carriage 670 and the nozzle assembly 44 in both manual and automatic modes of operation. The switch (not illustrated) for manually controlling the axial position of the carriage 670 and nozzle assembly 44 is located in the master control panel 720. The rotational and axial counters 390, 408 are located in the rotational control housing 724.

The transverse control housing 752 contains all of the pneumatic logic components necessary to control transverse positioning of the nozzle means 44 in both manual and automatic modes of operation. The switch used to manually position the nozzle means 44 transversely is located on the side of the transverse control housing 752. The transverse counter 426 is located in the transverse control housing 752.

The manual mode of operation may be used to position the carriage 670 and nozzle means 44 before initiation of automatic operation.

It is important to provide sufficient filtration of the air supply so that the pneumatic signal will be comprised of instrument quality compressed air. The presence of water or dirt in the pneumatic signal will cause the pneumatic components of the cleaning apparatus 20 to plug up and/or rust and will cause the apparatus 20 to malfunction. The air should be as clean and dry as possible. In the prototype cleaning apparatus 20, an air preparation unit (not illustrated) is provided which contains two filters, one for removal of particulates and the other for removal of water, oil, etc.

Most of the pneumatic components utilized in the cleaning apparatus 20 are commercially available from Clippard Instrument Labs or from Mac Valves, Inc., although some of the components, such as the first swivel 76, are manufactured by the assignee of the present invention. The Halliburton Company of Duncan, Oklahoma. Model numbers of representative components are included in the preceding description.

Figure 14:
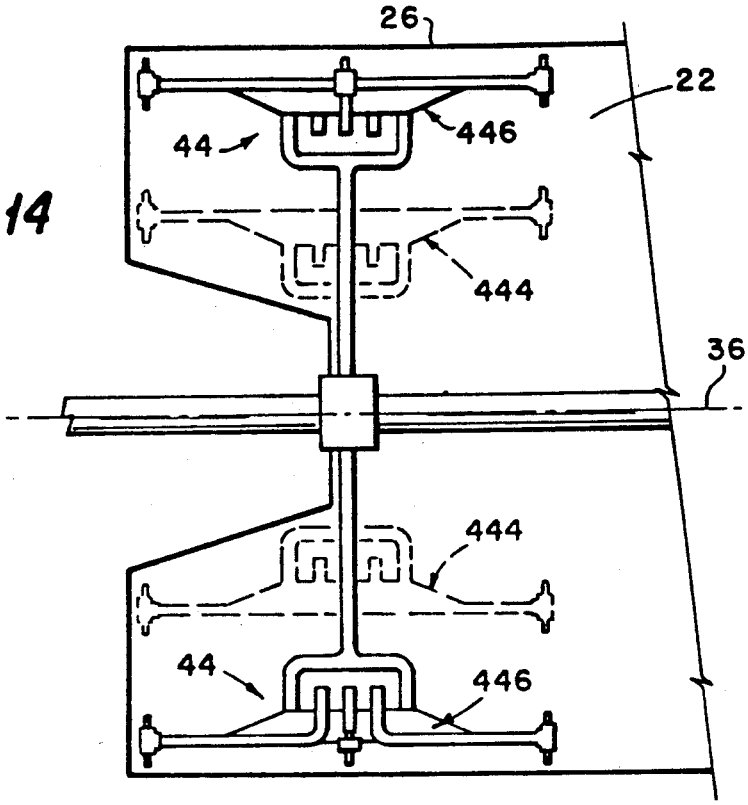
FIG. 14 is a schematic view illustrating the first and second transverse positions of the nozzle assembly of the present invention.
Figure 15:
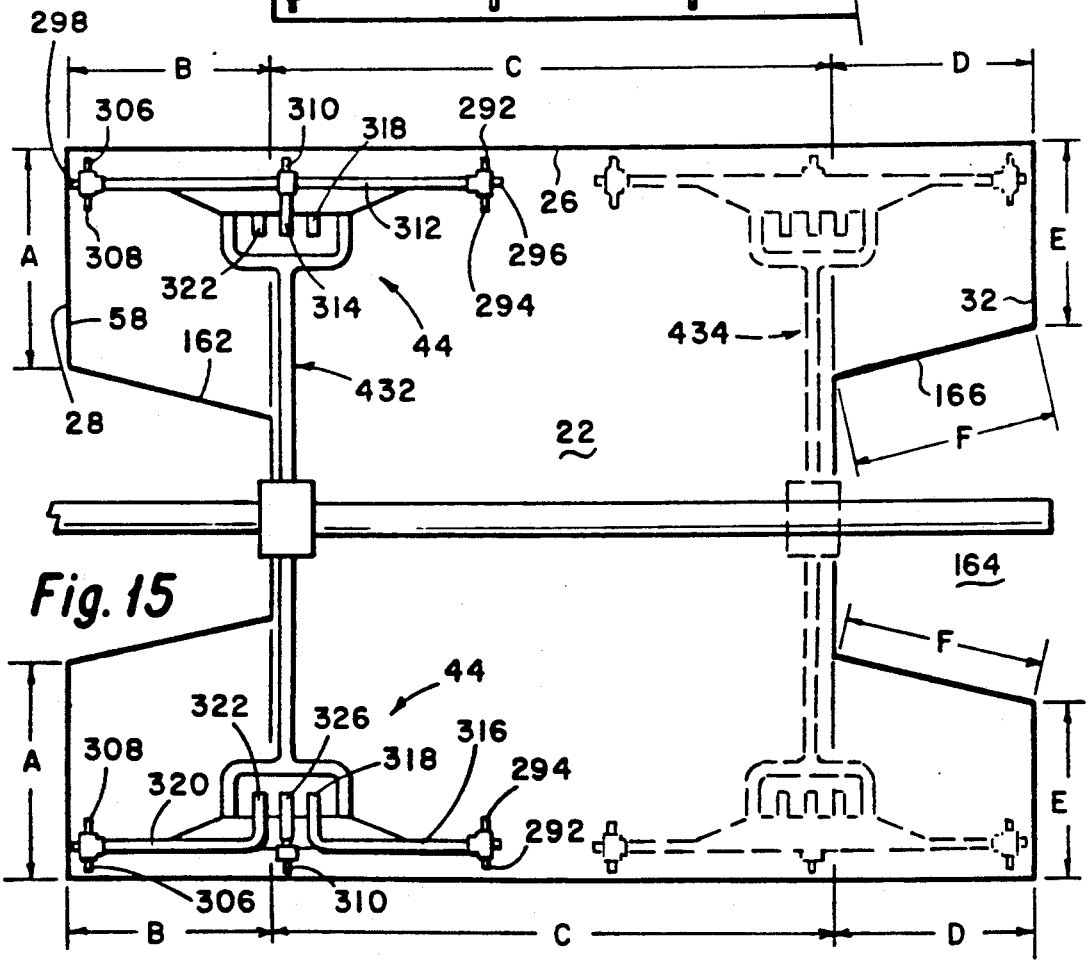
FIG. 15 is a schematic view illustrating the first and second axial positions of the nozzle assembly of the present invention.

Referring now to FIGS. 14 and 15, the operation and methodology of the present invention will be described. Initially, it is to be noted that the cyclone chamber 22 can be divided into six cleaning areas. These cleaning areas are denoted by the letters A, B, C, D, E, F in FIG. 15. The area A is defined by the interior surface 58 of first end wall 28. Area B includes the interior surfaces of inlet wall 162 and the interior surfaces of the side wall 26 which are transversely opposite or facing the interior surfaces of the inlet wall 162. Area C is that portion of the side wall 26 extending between the innermost extension of the inlet wall 162 and the innermost extension of the outlet wall 166. Area D includes the interior surfaces of the outlet wall 166 and the interior surfaces of the side wall 26 transversely opposite or facing the interior surfaces of the outlet wall 166. Area E includes the interior surface of the second end wall 32. Area F includes the outside surfaces of the outlet wall 166.

Although the following description of the steps by which these five areas are cleaned will be described in alphabetical order, it is intended to be understood that the cleaning can be effected through any suitable order of the steps.

To clean area A, the second ends 304 of the conducting means 300 (best seen in FIG. 1) are connected to inlets 314 of the first manifolds 312. Manifolds 312 conduct fluid to be sprayed through first and second axial nozzles 296, 298. It is then necessary to preselect the number of rotations of the nozzle assembly 44 to be made with each enablement of the rotational drive means 46 by entering the number of desired rotations in the rotational preselecting means 334. The transverse enabling means 352 should be positioned to enable the transverse drive means 68. The transverse distance the nozzle assembly 44 is to be moved with each enablement of the transverse drive means 68 should be selected by entering the appropriate digit or digits in the transverse preselecting means 354. As previously discussed, normally the perforations 420 in the transverse counting plate 418 will be spaced at approximately the desired distance of transverse travel and therefore normally the digit one will be entered into the transverse preselecting means 354. The cleaning apparatus 20 is then enabled by applying a pneumatic signal from the air supply 460. When it is desired to start rotation of the nozzle means 44, the rotational enabling means 332 is positioned to enable rotation. The nozzle assembly 44 then rotates the number of times preselected on the rotational preselecting means 334 and is disabled. The transverse drive means 68 is then enabled and advances the nozzle assembly 44 transversely the distance preselected on the transverse preselecting means 354. The apparatus 20 is then disabled until reenabling means 364 reenables the rotational drive means 46. This cycle of rotation and then transverse movement will repeat itself until disabled by the operator. Assuming the nozzle assembly 44 started operation in first transverse position 444 (best seen in FIG. 14), the nozzle assembly 44 will advance outwardly to second transverse position 446 at which point the transverse reversing means 448 should encounter the second transverse stop 452 which will reverse the transverse direction of motion of the nozzle assembly 44, as previously discussed.

The cleaning fluid is pumped by suitable pump means associated with fluid source 24 through fluid source conduit 702, second swivel 700, first swivel 76, conduit means 42, fluid tee 138, conducting means 300, to the axial nozzles 296, 298. The spray from nozzles 296, 298 loosens the slag from the interior surface of the first end wall 28. The oppositely directed sprays ejected from axial nozzles 296, 298 act as countering forces to prevent bending of the nozzle support arm 282, which would otherwise occur if the fluid were sprayed from only one nozzle 296, 298 because of the high pressure at which the fluid is sprayed.

When area A has been adequately cleaned, the operator at master control panel 720 stops the fluid flow from fluid source 24 and disables the cleaning apparatus 20 by closing valve 461 and removing the pneumatic signal from the air supply to the rotational drive means 46 or by positioning rotational enabling means 332 to disable rotation. Assuming area B is to be cleaned next, the second ends 304 of the conducting means 300 (best seen in FIG. 1) are then connected to inlets 322 of the third manifolds 320. Manifolds 320 conduct fluid to be sprayed through the third and fourth transverse nozzles 306, 308. The number of rotations of the nozzle assembly 44 to be made with each enablement of the rotational drive means 46 should be preselected by entering the number of desired rotations in the rotational preselecting means 334. The transverse enabling means 352 should be positioned to enable the axial drive means 48. The axial distance the nozzle assembly 44 is to be moved with each enablement of the axial drive means 48 should be selected by entering the appropriate digit or digits in the axial preselecting means 344. As previously discussed, normally the perforations 404 in the axial counting track 400 will be spaced at approximately the desired distance of axial travel (normally one inch with each enablement of the axial drive means 48) and therefore normally the digit one will be entered into the axial preselecting means 344. The cleaning apparatus 20 is then enabled by applying a pneumatic signal from the air supply 460 by opening valve 461. When it is desired to start rotation of the nozzle means 44, the rotational enabling means 332 is positioned to enable rotation. The nozzle assembly 44 then rotates the number of times preselected on the rotational preselecting means 334 and is disabled. The axial drive means 48 is then automatically enabled and advance the nozzle assembly 44 axially the distance preselected on the axial preselecting means 344. The apparatus 20 is then disabled until reenabling means 364 automatically reenables the rotational drive means 46. This cycle of rotation and then axial movement will repeat itself until disabled by the operator. Assuming the nozzle assembly 44 started operation in the first axial position 432 (best seen in FIG. 15), the nozzle assembly 44 will advance toward second axial position 434. If desired, the second axial stop 440 may be positioned so that the axial reversing means 436 will contact the second axial stop 440 when the third and fourth transverse nozzles 306, 308 are spraying the innermost end of inlet wall 162 so that the axial direction of the nozzle assembly 44 will be reversed, as previously discussed. The oppositely directed sprays 60 ejected from third and fourth transverse nozzles 306, 308 act as countering forces to prevent bending of the manifold assembly 286 and nozzle support arm 282 which would occur if the fluid were sprayed from only one transverse nozzle 306, 308 because of the high pressure at which the fluid is sprayed. The oppositely directed transverse sprays 60 may be used to simultaneously clean the interior surfaces of both the inlet wall 162 and the side wall 26, although if the slag deposits are too hard or if the distance between the inlet wall 162 and side wall 26 is too great, it may be necessary to execute the area B cleaning procedure for the interior surfaces of inlet wall 162 independently of the interior surfaces of the side wall 26. When the walls 26, 162 are to be cleaned independently, the nozzle assembly 44 should be transversely positioned to position the appropriate one of the third transverse nozzle 306 or fourth transverse nozzle 308 as close as possible to the inlet wall 162 or to the side wall 26 to be cleaned. When the side wall 26 and inlet wall 162 are to be cleaned simultaneously, the nozzle assembly 44 should be positioned approximately midway between the surfaces of the slag deposits on the walls 26, 162.

When area B has been adequately cleaned, the operator at master control panel 720 stops the fluid flow from fluid source 24 and disables the cleaning apparatus 20 by closing valve 461 to remove the pneumatic signal from the air supply to the rotational drive means 46 or by positioning rotational enabling means 332 to disable rotation. Assuming it is desired to clean area C next, the second ends 304 of the conducting means 300 (best seen in FIG. 1) are connected to inlets 326 of the fourth manifolds 324. Manifolds 324 conduct fluid to be sprayed through fifth transverse nozzles 310. It is then necessary to preselect the number of rotations of the nozzle assembly 44 to be made with each enablement of the rotational drive means 46, by entering the number of desired rotations in the rotational preselecting means 334. The transverse enabling means 352 should be positioned to enable the axial drive means 48. The axial distance the nozzle assembly is to be moved with each enablement of the axial drive means 48 should be selected by entering the appropriate digit or digits in the axial preselecting means 344. The cleaning apparatus is then enabled by applying a pneumatic signal from the air supply 460 by opening valve 461. When it is desired to start rotation of the nozzle means 44, the rotational enabling means 332 is positioned to enable rotation. The nozzle assembly 44 then rotates the number of times preselected on the rotational preselecting means 334 and is then disabled. The axial drive means 48 is then automatically enabled and advances the nozzle assembly 44 axially the distance preselected on the axial preselecting means 344. The apparatus 20 is then disabled until reenabling means 364 automatically reenables the rotational drive means 46. This cycle of rotation and then axial movement will repeat itself until the apparatus 20 is disabled or reset by the operator. Assuming the nozzle assembly 44 started operation in the first axial position 432 (best seen in FIG. 15), the nozzle assembly 44 will advance toward the second axial position 434 at which point the axial reversing means 436 will contact the second transverse stop 452 which will reverse the axial direction of motion of the nozzle assembly 44, as previously discussed.

When area C has been adequately cleaned, the operator at master control panel 720 stops the fluid flow from the fluid source 24 and disables the cleaning apparatus 20 by closing valve 461 and removing the pneumatic signal from the air supply to the rotational drive means 46 or by positioning rotational enabling means 332 to disable rotation. Assuming it is desired to clean area D next, the second ends 304 of conducting means 300 (best seen in FIG. 1) are then connected to inlets 318 of the second manifolds 316. Manifolds 316 conduct fluid to be sprayed through first and second transverse nozzles 292, 294. Operation of the cleaning apparatus 20 then proceeds as in the cleaning of area B discussed above. If desired, the first and second axial stops 438, 440 may be positioned so that the nozzle assembly will confine itself to cleaning area D.

When area D has been adequately cleaned, the operator at master control panel 720 stops the fluid flow from fluid source 24 and disables the cleaning apparatus 20 by closing valve 461 and removing the pneumatic signal from the air supply to the rotational drive means 46 or by positioning rotational enabling means 332 to disable rotation. Assuming it is desired to clean area E next, the second ends 304 of conducting means 300 (best seen in FIG. 1) are connected to inlets 314 of first manifolds 312. Manifolds 312 conduct fluid to be sprayed through first and second axial nozzles 296, 298. Operation of the cleaning apparatus 20 then proceeds as described with area A above.

When area E has been adequately cleaned, the operator at master control panel 720 stops the fluid flow from fluid source 24 and disables the cleaning apparatus 20 by closing valve 461 and removing the pneumatic signal from the air supply to the rotational drive means 46 or by positioning rotational enabling means 332 to disable rotation. Assuming it is desired to clean area F next, the second ends 304 of conducting means 300 (best seen in FIG. 1) are connected to inlets 318 of second manifolds 316. Manifolds 316 conduct fluid to be sprayed through the first and second transverse nozzles 292, 294. The nozzle assemblies 44 are positioned in a first transverse position 444 with the nozzles 292, 294 extending into the cyclone outlet 164. Operation of the cleaning apparatus 20 then proceeds generally as described with area D above.

In the preferred embodiment, the nozzles 292, 294, 296, 298, 306, 308, 310 have outlet spray ports (not illustrated). The size of the outlet spray port is determined by the pressure at which the fluid is supplied to the nozzles. In the preferred embodiment, it has been found that outlet spray ports of approximately one-quarter inch diameter work well at fluid pressures of approximately 4,500 to 5,000 pounds per square inch and that spray ports of approximately one-eighth inch diameter work well if the fluid is supplied at a pressure of approximately 7,000 pounds per square inch. In general, as the depth of the slag deposit on the inside of the chamber increases, the diameter of the nozzle spray port should be increased. Larger diameter spray ports will carry more fluid energy greater distances. It is contemplated that various sizes of spray ports and various fluid pressures will be utilized with the cleaning apparatus 20.

While the invention has been described with a certain degree of particularity, it is manifest that many changes may be made in the details of construction and arrangement of components without departing from the spirit and scope of this disclosure. It is intended to be understood that the invention is not limited to the embodiments and methods set forth herein for purposes of exemplification, that the invention is to be limited only by the scope of the attached claims, including the full range of equivalency to which each element thereof is entitled.

What is claimed is:

1. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the interior of the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel or coaxial with the longitudinal axis;

axial drive means for moving the nozzle means toward and away from the first end wall a preselected distance in response to rotation of the nozzle means; and support means for supporting the nozzle means and for allowing motion of the nozzle means.

2. The apparatus of claim 1, further comprising:

transverse drive means for moving the nozzle means transversely toward or away from the rotational axis a preselected distance in response to rotation of the nozzle means.

3. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the interior of the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel or coaxial with the longitudinal axis, the rotational drive means comprising;

rotational enabling means for enabling the rotational drive means to rotate the nozzle means;

rotational preselecting means for preselecting the number of rotations of the nozzle means to be made after enablement of the rotational drive means;

rotational counting means for counting the number of rotations of the nozzle means; and rotational disabling means for disabling rotation of the nozzle means when the preselected number of rotations are completed;

axial drive means for moving the nozzle means toward and away from the first end wall, the axial drive means moving the nozzle means a preselected distance for each rotation of the nozzle means, the axial drive means comprising:

axial enabling means for enabling the axial drive means to move the nozzle means when the rotational disabling means disables rotation of the nozzle means;

axial preselecting means for preselecting the distance the nozzle means may be moved by the axial drive means after enablement of the axial drive means;

axial measuring means for measuring the distance the nozzle means is moved by the axial drive means; and axial disabling means for disabling movement of the nozzle means by the axial drive means when the nozzle means has been moved the preselected distance by the axial drive means; and support means for supporting the nozzle means and for allowing motion of the nozzle means.

4. The apparatus of claim 3, wherein the axial drive means moves the nozzle means axially between a first axial position nearer the first end wall and a second axial position nearer the second end wall; and in which the axial drive means comprises:

axial reversing means for automatically reversing the axial motion of the nozzle means when the nozzle means reaches the first axial position and when the nozzle means reaches the second axial position.

5. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the interior of the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel or coaxial with the longitudinal axis;

axial drive means for moving the nozzle means toward and away from the first end wall, the axial drive means moving the nozzle means a preselected distance for each rotation of the nozzle means;

transverse drive means for moving the nozzle means transversely toward or away from the rotational axis, the transverse drive means moving the nozzle means a pre-selected distance for each rotation of the nozzle means; and support means for supporting the nozzle means and for allowing motion of the nozzle means; and wherein the rotational drive means is further defined as providing a rotational signal indicating each rotation of the nozzle means; and wherein the transverse drive means is further defined as responding to the rotational signal for transversely moving the nozzle means; and in which the apparatus comprises:

signal conducting means, connected between the rotational drive means and the transverse drive means, for conducting the rotational signal from the rotational drive means to the transverse drive means.

6. The apparatus of claim 5, comprising:

a first swivel, comprising:

an outer sleeve body including an outside surface; an inside surface; at least one outer passageway extending through the outer sleeve body from the outside surface to the inside surface, the outer passageway having a first end at the outside surface and a second end at the inside surface; and an inner sleeve body, generally coaxially and rotatably positionable in the outer sleeve body, the inner sleeve body including an outside surface; an inside surface; at least one inner passageway extending through the inner sleeve body, the inner passageway having a first end fluidly communicable with the second end of the outer passageway and a second end; and in which the apparatus further comprises:

an elongate hollow member having a first end connectable to the inner sleeve body generally coaxially with the inner sleeve body and a second end connectable to the nozzle means; and wherein the rotational drive means rotates the conduit means about the rotational axis of the nozzle means; and wherein the conduit means passes generally concentrically through the inner sleeve body and the elongate hollow member and is connected to the inner sleeve body and the elongate hollow member are rotated with the conduit means; and wherein the transverse drive means is located adjacent the nozzle means; and in which the signal conducting means comprises:

a first segment fluid comminicatingly connectable from the rotational drive means to the first end of the outer passageway of the outer sleeve body; and a second segment fluid communicatingly connectable from the second end of the inner passageway of the inner sleeve body through the hollow elongate member to the transverse drive means so that the second segment rotates with the inner sleeve body.

7. The apparatus of claim 6 in which the first swivel comprises:

circumferential channel means for placing the second end of the outer passageway in continuous fluid communication with the first end of the inner passageway throughout the rotation of the inner sleeve body relative to the outer sleeve body.

8. The apparatus of claim 7 in which the first swivel comprises:

at least two outer passageways through the outer sleeve body;

at least two inner passageways through the inner sleeve body; and at least two circumferential channel means, one outer passageway and one inner passageway being in continuous fluid communication with each circumferential channel means.

9. The apparatus of claim 6, further comprising:

a second swivel having a rotatable inner sleeve, the inner sleeve having a first end fluid communicatingly connectable with the fluid source and a second end fluid communicatingly connectable to the conduit means; and in which the rotational drive means comprises:

motor means, connectable to the inner sleeve of the second swivel, for rotating the inner sleeve and the conduit means.

10. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the interior of the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel or coaxial with the longitudinal axis;

axial drive means for moving the nozzle means toward and away from the first end wall, the axial drive means moving the nozzle means a preselected distance for each rotation of the nozzle means; and support means for supporting the nozzle means and for allowing motion of the nozzle means; and wherein the chamber has an inlet having an inlet wall surrounding the inlet opening and extending generally axially from the first end wall, the inlet wall being spaced from the side wall;

in which the support means comprises:

a beam, positionable generally parallel or coaxially with the longitudinal axis of the chamber, the beam having a first end extending away from the chamber and a second end adjacent the inlet opening; and a beam support, positionable in the inlet, comprising:

vertical support means for extending generally linearly across the inlet to a first contact and a second contact with the inlet wall and for elevating and supporting the beam in a position generally parallel with the longitudinal axis of the chamber;

first strut means for extending from the vertical support means to a third contact with the inlet wall and for stabilizing the beam support, the third contact being located between the first and second contacts; and second strut means for extending from the vertical support means to a fourth contact with the inlet wall and for stabilizing the beam support, the fourth contact being located between the second and third contacts.

11. The apparatus of claim 10:

wherein the vertical support means is positionable generally horizontally and transversely across the inlet; and wherein the first strut means extends generally upwardly from the vertical support means to the third contact and the second strut means extends generally upwardly from the vertical support means to the fourth contact.

12. The apparatus of claim 10:

in which the vertical support means comprises:

a beam rest for supportingly contacting the beam, the beam rest extending generally transversely beyond the sides of the beam;

a first leg, extendably connected to the beam rest, for extending to the first contact; and a second leg, extendably connected to the beam rest, for extending to the second contact; and wherein the first strut means is extendably connected to the beam rest adjacent one side of the beam and the second strut means is extendably connected to the beam rest adjacent to the opposite side of the beam.

13. The apparatus of claim 12:

wherein the first, second, third, and fourth contacts are generally coplanar.

14. The apparatus of claim 13:

wherein the third contact is about midway between the first contact and a line perpendicular to the vertical support means at the center of the beam rest and the fourth contact is about midway between the second contact and the line perpendicular to the vertical support means at the center of the beam rest.

15. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the interior of the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel or coaxial with the longitudinal axis;

axial drive means for moving the nozzle means toward and away from the first end wall, the axial drive means moving the nozzle means a preselected distance for each rotation of the nozzle means; and support means for supporting the nozzle means and for allowing motion of the nozzle means; and wherein the rotational drive means rotates the conduit means about the rotational axis of the nozzle means in order to rotate the nozzle means; and in which the nozzle means comprises:

a nozzle assembly, comprising:

a transverse support arm extending transversely to the longitudinal axis of the chamber, the support arm having a first end connected to the conduit means and a second end extending transversely toward the side wall;

a manifold assembly connected to the second end of the support arm, the manifold assembly having a longitudinal axis extending generally parallel to the longitudinal axis of the chamber, the manifold assembly having a first end extending in one axial direction from the support arm and a second end extending in the other axial direction from the support arm; and at least one nozzle, connected to the manifold assembly, for spraying fluid transversely away from the longitudinal axis of the chamber;

at least one nozzle, connected to the manifold assembly, for spraying fluid transversely toward the longitudinal axis of the chamber;

at least one nozzle, connected to the manifold assembly, for spraying fluid in one axial direction;

at least one nozzle, connected to the manifold assembly, for spraying fluid in the other axial direction; and conducting means for conducting fluid from the conduit means to the manifold assembly.

16. The apparatus of claim 15 in which the nozzle assembly comprises:

a first axial nozzle, connected to the first end of the manifold assembly, for spraying fluid axially away from the first end of the manifold assembly;

a second axial nozzle, connected to the second end of the manifold assembly, for spraying fluid axially away from the second end of the manifold assembly;

a first transverse nozzle, connected to the first end of the manifold assembly, for spraying fluid transversely away from the longitudinal axis of the chamber;

a second transverse nozzle, connected to the first end of the manifold assembly, for spraying fluid transversely toward the longitudinal axis of the chamber;

a third transverse nozzle, connected to the second end of the manifold assembly, for spraying fluid transversely away from the longitudinal axis of the chamber;

a fourth transverse nozzle, connected to the second end of the manifold assembly, for spraying fluid transversely toward the longitudinal axis of the chamber; and a fifth transverse nozzle, connected to the manifold assembly approximately mid-way between the first and second ends, for spraying fluid transversely away from the longitudinal axis of the chamber.

17. The apparatus of claim 16 in which the manifold assembly comprises:

a first manifold connected to the first and second axial nozzles for conducting fluid to the first and second axial nozzles, the first manifold having an inlet connection;

a second manifold connected to the first and second transverse nozzles for conducting fluid to the first and second transverse nozzles, the second manifold having an inlet connection;

a third manifold connected to the third and fourth transverse nozzles for conducting fluid to the third and fourth transverse nozzles, the third manifold having an inlet connection; and a fourth manifold connected to the fifth transverse nozzle for conducting fluid to the fifth transverse nozzle, the fourth manifold having an inlet connection.

18. The apparatus of claim 17, comprising:

two nozzle assemblies having transverse support arms extending in opposite directions from the conduit means.

19. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel or coaxial with the longitudinal axis, the rotational drive means comprising:

rotational enabling means for enabling the rotational drive means to rotate the nozzle means;

rotational preselecting means for preselecting the number of rotations of the nozzle means to be made after enablement of the rotational drive means;

rotational counting means for counting the number of rotations of the nozzle means; and rotational disabling means for disabling rotation of the nozzle means when the preselected number of rotations are completed;

axial drive means for moving the nozzle means toward and away from the first end wall, the axial drive means moving the nozzle means a preselected distance for each rotation of the nozzle means, the axial drive means comprising:

axial enabling means for enabling the axial drive means to move the nozzle means when the rotational disabling means disables rotation of the nozzle means;

axial preselecting means for preselecting the distance the nozzle means may be moved by the axial drive means after embodiment of the axial drive means;

axial measuring means for measuring the distance the nozzle means is moved by the axial drive means; and axial disabling means for disabling movement of the nozzle means by the axial drive means when the nozzle means has been moved the preselected distance by the axial drive means;

transverse drive means for moving the nozzle means transversely towards or away from the rotational axis, the transverse drive means moving the nozzle means a preselected distance for each rotation of the nozzle means, the transverse drive means comprising:

transverse enabling means for enabling the transverse drive means to move the nozzle means when the rotational disabling means disables rotation of the nozzle means;

transverse preselecting means for preselecting the distance the nozzle means may be moved by the transverse drive means after enablement of the transverse drive means;

transverse measuring means for measuring the distance the nozzle means is moved by the transverse drive means; and transverse disabling means for disabling movement of the nozzle means by the transverse drive means when the nozzle means has been moved the preselected distance by the transverse drive means; and support means for supporting the nozzle means and for allowing motion of the nozzle means.

20. The apparatus of claim 19, comprising:

switch means for preselecting one of the axial drive means and the transverse drive means to move the nozzle means when the rotational drive means is disabled.

21. The apparatus of claim 20, comprising:

reenabling means for reenabling the disabled rotational drive means to rotate the nozzle means after the one of the axial drive means and the transverse drive means preselected by the switch means has moved the nozzle means the preselected distance and is disabled.

22. The apparatus of claim 19, comprising:

reenabling means for reenabling the disabled rotational drive means to rotate the nozzle means a preselected period of time after the rotation drive means is disabled.

23. The apparatus of claim 19:

wherein the transverse drive means moves the nozzle means transversely between a first transverse position nearer the rotational axis and a second transverse position nearer the chamber side wall; and in which the transverse drive means comprises:

transverse reversing means for automatically reversing the transverse motion of the nozzle means when the nozzle means reaches the first transverse position and when the nozzle means reaches the second transverse position.

24. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel to the longitudinal axis: the rotational drive means comprising:

rotational enabling means for enabling the rotational drive means to rotate the nozzle means;

rotational preselecting means for preselecting the number of rotations of the nozzle means to be made after enablement of the rotational drive means;

rotational counting means for counting the number of rotations of the nozzle means; and rotational disabling means for disabling rotation of the nozzle means when the preselected number of rotations are completed;

axial drive means for moving the nozzle means axially between a first axial position near the first end wall and a second axial position near the second end wall, the axial drive means moving the nozzle means a preselected distance for each rotation of the nozzle means, the axial drive means comprising:

axial enabling means for enabling the axial drive means to move the nozzle means after the rotational disabling means disables rotation of the nozzle means;

axial preselecting means for preselecting the distance the nozzle means may be moved by the axial drive means after embodiment of the axial drive means;

axial measuring means for measuring the distance the nozzle means is moved by the axial drive means;

axial disabling means for disabling movement of the nozzle means by the axial drive means after the nozzle means has been moved the preselected axial distance by the axial drive means; and axially reversing means for automatically reversing the axial motion of the nozzle means when the nozzle means reaches the first axial position and when the nozzle means reaches the second axial position;

transverse drive means for moving the nozzle means transversely towards a first transverse position near the rotational axis and a second transverse position near the rotational axis and a second transverse position near the chamber side wall, the transverse drive means moving the nozzle means a preselected distance for each rotation of the nozzle means, the transverse drive means comprising:

transverse enabling means for enabling the transverse drive means to move the nozzle means after the rotational disabling means disables rotation of the nozzle means;

transverse preselecting means for preselecting the distance the nozzle means may be moved by the transverse drive means after enablement of the transverse drive means;

transverse measuring means for measuring the distance the nozzle means is moved by the transverse drive means;

transverse disabling means for disabling movement of the nozzle means by the transverse drive means after the nozzle means has been moved the preselected distance by the transverse drive means; and transverse reversing means for reversing the transverse motion of the nozzle means when the nozzle means reaches the first transverse position and when the nozzle means reaches the second transverse position;

switch means for preselecting one of the axial drive means and the transverse drive means to move the nozzle means when the rotational drive means is disabled;

reenabling means for reenabling the disabled rotational drive means to rotate the nozzle means after the one of the axial drive means and the transverse drive means preselected by the switch means has moved the nozzle means the preselected distance and is disabled; and support means for supporting the nozzle means and for allowing motion of the nozzle means.

25. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the chamber; the apparatus comprising:

conduit means for conducting fluid from the fluid source into the chamber;

nozzle means, connectable to the conduit means, for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel to the longitudinal axis and for providing a rotational signal indicating each rotation of the nozzle means;

transverse drive means for responding to the rotational signal and moving the nozzle means transversely toward or away from the rotational axis;

support means for supporting the nozzle means and for allowing motion of the nozzle means;

signal conducting means, connected between the rotational drive means and the transverse drive means, for conducting the rotational signal from the rotational drive means to the transverse drive means;

a first swivel, comprising:

an outer sleeve body, including an outside surface; an inside surface; at least one outer passageway extending through the outer sleeve body from the outside surface to the inside surface, the outer passageway having a first end at the outside surface and a second end at the inside surface; and an inner sleeve body, generally coaxially and rotatably positionable in the outer sleeve body, the inner sleeve body including an outside surface; an inside surface; at least one inner passageway extending through the inner sleeve body, the inner passageway having a first end fluidly comminicable with the second end of the outside passageway and a second end;

an elongate hollow member having a first end connectable to the inner sleeve body generally coaxially with the inner sleeve body and a second end connectable to the nozzle means; and wherein the rotational drive means rotates the conduit means about the rotational axis of the nozzle means; and wherein the conduit means passes generally concentrically through the inner sleeve body and the elongate hollow member and is connected to the inner sleeve body of the first swivel so that the inner sleeve body and the elongate hollow member are rotated with the conduit means; and wherein the transverse drive means is located adjacent the nozzle means; and in which the signal conducting means further comprises:

a first segment fluid communicatingly connectable from the rotational drive means to the first end of the outer passageway of the outer sleeve body; and a second segment fluid communicatingly connectable from the second end of the inner passageway of the inner sleeve body through the hollow elongate member to the transverse drive means so that the second segment rotates with the inner sleeve.

26. The apparatus of claim 25 in which the outer sleeve body of the first swivel comprises:

circumferential channel means in the inside surface of the outer sleeve body for placing the second end of the outer passageway in continuous fluid communication with the first end of the inside passageway throughout the rotation of the inner sleeve body relative to the outer sleeve body.

27. The apparatus of claim 25 in which the first swivel comprises:

at least two outer passageways through the outer sleeve body;

at least two inner passageways through the inner sleeve body; and at least two circumferential channel means, one outer passageway and one inner passageway being in continuous fluid communication with each circumferential channel means.

28. Apparatus for cleaning a chamber with a fluid from a fluid source; the chamber including a side wall; a first end wall having an inlet opening; a second end wall having an outlet opening; the inlet and outlet openings generally defining a longitudinal axis extending through the chamber; and an inlet having an inlet wall surrounding the inlet opening and extending axially from the first end wall; the apparatus comprising:

conduit means for conducting fluid from the fluid into the chamber;

nozzle means, connectable to the conduit means. for creating a selectable one of an axial fluid spray to clean the interior surfaces of the first and second end walls and a transverse fluid spray to clean the interior surfaces of the side wall;

rotational drive means for rotating the nozzle means about a rotational axis generally parallel to the longitudinal axis:

axial drive means for moving the nozzle means toward and away from the first end wall; and support means for supporting the nozzle means and for allowing motion of the nozzle means, the support means comprising:

a beam, positionable generally parallel or coaxial with the longitudinal axis of the chamber, the beam having a first end extending away from the chamber and a second end adjacent the inlet opening: and a beam support, positionable in the inlet, comprising:

vertical support means, for extending generally linearly across the inlet to a first contact and a second contact with the inlet wall and for elevating and supporting the beam in a position generally parallel with the longitudinal axis of the chamber;

first strut means for extending from the vertical support means to a third contact with the inlet wall and for stabilizing the beam support, the third contact being located between the first and second contact; and second strut means for extending from the vertical support means to a fourth contact with the inlet wall and for stabilizing the beam support, the fourth contact being located between the second and third contacts.

29. The apparatus of claim 28:

wherein the vertical support means is positionable generally horizontally and transversely across the inlet; and wherein the first strut means extends generally upwardly from the vertical support means to the third contact and the second strut means extends generally upwardly from the vertical support means to the fourth contact.

30. The apparatus of claim 28:

in which the vertical support means comprises:

a beam rest for supportingly contacting the beam, the beam rest extending generally transversely beyond the sides of the beam;

a first leg, extendably connected to the beam rest, for extending to the first contact; and a second leg, extendably connected to the beam rest, for extending to the second contact; and wherein the first strut means is extendably connected to the beam rest adjacent one side of the beam and the second strut means is extendably connected to the beam rest adjacent the opposite side of the beam.

31. The apparatus of claim 30:

wherein the first, second, third, and fourth contacts are generally coplanar.

32. The apparatus of claim 31:

wherein the third contact is about midway between the first contact and a line perpendicular to the vertical support means at the center of the beam rest and the fourth contact is about midway between the second contact and the line perpendicular to the vertical support means.

33. Apparatus for cleaning a chamber with a fluid from a fluid source; the chamber including a side wall, a first end wall having an inlet opening, and a second end wall having an outlet opening; the inlet and outlet openings generally defining a longitudinal axis extending through the chamber; the apparatus comprising:

conduit means for conducting fluid from the fluid source into the chamber;

a nozzle assembly, comprising:

a transverse support arm extending transversely to the longitudinal axis of the chamber, the support arm having a first end connectable to the conduit means and a second end extending transversely toward the side wall;

a manifold assembly connected to the second end of the support arm, the manifold assembly having a longitudinal axis extending generally parallel to the longitudinal axis of the chamber, the manifold assembly having a first end extending in one axial direction from the support arm and a second end extending in the other axial direction from the support arm;

at least one nozzle, connected to the manifold assembly, for spraying fluid transversely away from the longitudinal axis of the chamber;

at least one nozzle, connected to the manifold assembly, for spraying fluid transversely toward the longitudinal axis of the chamber;

at least one nozzle, connected to the manifold assembly, for spraying fluid in one axial direction;

at least one nozzle, connected to the manifold assembly, for spraying fluid in the other axial direction; and conducting means for conducting fluid from the conduit means to the manifold assembly;

rotational drive means for rotating the nozzle assembly about a rotational axis generally parallel to the longitudinal axis of the chamber;

axial drive means for moving the nozzle means toward and away from the first end wall; and support means for supporting the nozzle means and for allowing motion of the nozzle means.

34. The apparatus of claim 33, comprising:

a first axial nozzle, connected to the first end of the manifold assembly, for spraying fluid axially away from the first end of the manifold assembly;

a second axial nozzle, connected to the second end of the manifold assembly, for spraying fluid axially away from the second end of the manifold assembly;

a first transverse nozzle, connected to the first end of the manifold assembly, for spraying fluid transversely away from the longitudinal axis of the chamber;

a second transverse nozzle, connected to the first end of the manifold assembly, for spraying fluid transversely toward the longitudinal axis of the chamber;

a third transverse nozzle, connected to the second end of the manifold assembly, for spraying fluid transversely away from the longitudinal axis of the chamber;

a fourth transverse nozzle, connected to the second end of the manifold assembly, for spraying fluid transversely toward the longitudinal axis of the chamber; and a fifth transverse nozzle, connected to the manifold assembly approximately midway between the first and second ends, for spraying fluid transversely away from the longitudinal axis of the chamber.

35. The apparatus of claim 34 in which the manifold assembly comprises:

a first manifold connected to the first and second axial nozzles for conducting fluid to the first and second axial nozzles, the first manifold having an inlet connection;

a second manifold connected to the first and second transverse nozzles for conducting fluid to the first and second transverse nozzles, the second manifold having an inlet connection;

a third manifold connected to the third and fourth transverse nozzles for conducting fluid to the third and fourth transverse nozzles, the third manifold having an inlet connection; and a fourth manifold connected to the fifth transverse nozzle for conducting fluid to the fifth transverse nozzle, the fourth manifold having an inlet connection.

36. The apparatus of claim 35, comprising:

two nozzle assemblies having transverse support arms extending in opposite directions from the conduit means.

37. The apparatus of claim 33, further comprising:

transverse drive means for moving the nozzle assembly transversely toward or away from the rotational axis.

* * * * *